US009411307B2

(12) United States Patent
Matsuda et al.

(10) Patent No.: US 9,411,307 B2
(45) Date of Patent: Aug. 9, 2016

(54) PROCESS CARTRIDGE AND ELECTROPHOTOGRAPHIC APPARATUS

(71) Applicant: CANON KABUSHIKI KAISHA, Tokyo (JP)

(72) Inventors: Hidekazu Matsuda, Susono (JP); Daisuke Tanaka, Yokohama (JP); Atsushi Uematsu, Fuji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/284,945

(22) Filed: May 22, 2014

(65) Prior Publication Data

US 2014/0255838 A1 Sep. 11, 2014

Related U.S. Application Data

(63) Continuation of application No. PCT/JP2013/005589, filed on Sep. 20, 2013.

(30) Foreign Application Priority Data

Jan. 24, 2013 (JP) ..... 2013-011314

(51) Int. Cl.
*G03G 21/18* (2006.01)
*G03G 5/147* (2006.01)
*G03G 15/02* (2006.01)

(52) U.S. Cl.
CPC ..... *G03G 21/1814* (2013.01); *G03G 5/14708* (2013.01); *G03G 5/14752* (2013.01); *G03G 5/14756* (2013.01); *G03G 5/14773* (2013.01); *G03G 15/0233* (2013.01)

(58) Field of Classification Search
CPC ..... G03G 15/0233; G03G 5/14773; G03G 5/14752; G03G 5/14756; G03G 21/1814
USPC ..... 399/174, 175, 176, 111; 430/58.2, 66
See application file for complete search history.

(56) References Cited

U.S. PATENT DOCUMENTS 4,444,861 A * 4/1984 Nogami et al. ..... 430/58.05
4,716,091 A 12/1987 Yoshihara et al.

(Continued)

FOREIGN PATENT DOCUMENTS

JP 58-167606 A 10/1983
JP 62-75462 A 4/1987

(Continued)

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

(Continued)

*Primary Examiner* — Christopher Rodee
(74) *Attorney, Agent, or Firm* — Fitzpatrick, Cella, Harper & Scinto

(57) ABSTRACT

A process cartridge that can suppress production of a banding image attributed to contact rotation of an electrophotographic photosensitive member and a charging member and output a high-quality image is provided. The charging member includes an electro-conductive substrate and an electroconductive resin layer, the resin layer contains a binder, a conductive fine particle, and a bowl-shaped resin particle having an opening, and the surface of the charging member has a concavity derived from the opening of the bowl-shaped resin particle and a protrusion derived from the edge of the opening thereof. The electrophotographic photosensitive member includes a support and a photosensitive layer, and the surface layer in the photosensitive member contains a specific resin (α), a specific resin (β), and a specific compound (γ).

11 Claims, 5 Drawing Sheets

(56) References Cited

U.S. PATENT DOCUMENTS

| | | | | |
|---|---|---|---|---|
| 6,899,983 | B2 | 5/2005 | Tamoto et al. | |
| 7,869,741 | B2 | 1/2011 | Mayuzumi et al. | |
| 8,532,534 | B2 | 9/2013 | Taniguchi et al. | |
| 2011/0044725 | A1 | 2/2011 | Mayuzumi et al. | |
| 2011/0305481 | A1* | 12/2011 | Taniguchi et al. | 399/115 |
| 2013/0029256 | A1 | 1/2013 | Tanaka et al. | |
| 2014/0205940 | A1 | 7/2014 | Tanaka et al. | |
| 2014/0205941 | A1 | 7/2014 | Nishi et al. | |

FOREIGN PATENT DOCUMENTS

| | | | | |
|---|---|---|---|---|
| JP | 7-13368 | A | | 1/1995 |
| JP | 7-261440 | A | | 10/1995 |
| JP | 2002-128883 | A | | 5/2002 |
| JP | 2002128883 | A | * | 5/2002 |
| JP | 2003-295490 | A | | 10/2003 |
| JP | 2006-133590 | A | | 5/2006 |
| JP | 2007-47655 | A | | 2/2007 |
| JP | 2007-72277 | A | | 3/2007 |
| JP | 2007-79555 | A | | 3/2007 |
| JP | 2007-199688 | A | | 8/2007 |
| JP | 2010126652 | A | * | 6/2010 |
| JP | 2011-248353 | A | | 12/2011 |
| JP | 2013-50700 | A | | 3/2013 |
| WO | 2010/050615 | A1 | | 5/2010 |

OTHER PUBLICATIONS

English language machine translation of JP 2010-126652 (Jun. 2010).*

English language machine translation of JP 2002-128883 (May 2002).*

Miyagawa, et al., U.S. Appl. No. 14/308,396, filed Jun. 18, 2014.

International Preliminary Report on Patentability, International Application No. PCT/JP2013/005589, Mailing Date Aug. 6, 2015.

International Search Report dated Nov. 5, 2013 in International Application No. PCT/JP2013/005589.

* cited by examiner

PROCESS CARTRIDGE AND ELECTROPHOTOGRAPHIC APPARATUS

CROSS-REFERENCE TO RELATED APPLICATIONS

This application is a continuation of International Application No. PCT/JP2013/005589, filed Sep. 20, 2013, which claims the benefit of Japanese Patent Application No. 2013-011314, filed Jan. 24, 2013.

BACKGROUND OF THE INVENTION

1. Field of the Invention

The present invention relates to a process cartridge and an electrophotographic apparatus.

2. Description of the Related Art

In an electrophotographic image forming apparatus (hereinafter referred to as an "electrophotographic apparatus"), processes such as charging, exposure, developing, transfer, and cleaning are performed repeatedly. Here, electrical and mechanical loads are applied to the surface of the electrophotographic photosensitive member in these processes, and therefore high durability against these loads is required. Moreover, high lubrication is required between the surface of the electrophotographic photosensitive member and a process member that is in contact with the surface of the electrophotographic photosensitive member, such as a cleaning blade for removing a transfer remaining toner.

For the problem of the above lubrication, Japanese Patent Application Laid-Open No. H07-13368 proposes a method including adding a silicone oil such as polydimethylsiloxane to the surface layer of an electrophotographic photosensitive member.

In the electrophotographic apparatus, a charging member is in contact with the electrophotographic photosensitive member at a predetermined contact pressure all the time, and rotates following the rotation of the electrophotographic photosensitive member. The charging member needs to stably rotate following the rotation of the electrophotographic photosensitive member having increased lubrication all the time.

Japanese Patent Application Laid-Open No. 2006-133590 proposes a method for improving grip properties to an electrophotographic photosensitive member, wherein a composite particle is contained in a coating layer in a charging member and the composite particle is obtained by coating a mother particle with a conductive material different from the mother particle.

SUMMARY OF THE INVENTION

Based on the disclosures in Japanese Patent Application Laid-Open No. H07-13368 and Japanese Patent Application Laid-Open No. 2006-133590, the present inventors studied a combination of an electrophotographic photosensitive member having a surface with high lubrication and a charging member having high grip properties to the electrophotographic photosensitive member. As a result, the combination may cause a slight slip between the electrophotographic photosensitive member and the charging member when the electrophotographic photosensitive member rotates in contact with the charging member, and unevenness may appear on an electrophotographic image as horizontal streaks attributed to the slip. Hereinafter, the electrophotographic image having the unevenness appearing as horizontal streaks may be referred to as a "banding image."

Accordingly, the present invention is directed to providing a process cartridge and electrophotographic apparatus that enable suppression of production of a banding image attributed to the slip between an electrophotographic photosensitive member and a charging member, and as a result can form a high-quality electrophotographic image.

According to one aspect of the present invention, there is provided a process cartridge including a charging member and an electrophotographic photosensitive member which is electrically charged upon being brought into contact with the charging member, wherein the charging member includes an electro-conductive substrate and an electroconductive resin layer formed on the electro-conductive substrate; the electro-conductive resin layer contains a binder, a conductive fine particle, and a bowl-shaped resin particle which has an opening; and the surface of the charging member has a concavity derived from the opening of the bowl-shaped resin particle and a protrusion derived from an edge of the opening of the bowl-shaped resin particle, and wherein the electrophotographic photosensitive member includes a support and a photosensitive layer formed on the support, and a surface layer of the electrophotographic photosensitive member contains the following resin (α), resin (β), and compound (γ):

resin (α): at least one resin selected from the group consisting of polycarbonate resins having no siloxane structure at a terminal and polyester resins having no siloxane structure at a terminal;

resin (β): at least one resin selected from the group consisting of polycarbonate resins having a siloxane structure at a terminal and polyester resins having a siloxane structure at a terminal, and acrylic resins having a siloxane structure at a terminal; and compound (γ): at least one compound selected from the group consisting of methyl benzoate, ethyl benzoate, benzyl acetate, ethyl 3-ethoxypropionate, and diethylene glycol ethyl methyl ether.

Moreover, the present invention provides an electrophotographic apparatus having the above process cartridge.

The present invention can suppress production of a banding image attributed to a slip between the electrophotographic photosensitive member and the charging member, and form a high-quality electrophotographic image.

Further features of the present invention will become apparent from the following description of exemplary embodiments with reference to the attached drawings.

DESCRIPTION OF THE EMBODIMENTS

Figure 1A:
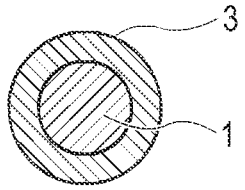
FIG. 1A is a sectional view of a charging member according to the present invention (in a form of a roller).

Preferred embodiments of the present invention will now be described in detail in accordance with the accompanying drawings.

The present inventors presume that a mechanism to exhibit the effect in the process cartridge according to the present invention is as follows. The surface of the charging member has a concavity and protrusion derived from the bowl-shaped resin particle. When the charging member is brought into contact with the electrophotographic photosensitive member, the protrusion elastically deforms to suppress vibration of the charging member, and the protrusion and its surrounding portion always are in contact with the electrophotographic photosensitive member. Meanwhile, in formation of an electrophotographic image, a DC voltage is applied to the charging member. At this time, the compound γ polarizes in the surface layer in the electrophotographic photosensitive member, and an electrical attractive force acts between the electrophotographic photosensitive member and the protrusion of the charging member contacting the electrophotographic photosensitive member. As a result, the charging member and the electrophotographic photosensitive member attract each other to suppress production of a slight slip when the charging member and the electrophotographic photosensitive member contact and rotate, as a result suppressing the banding image.

<Electrophotographic Photosensitive Member>

The electrophotographic photosensitive member is electrically contact-charged by the charging member according to the present invention includes a support and a photosensitive layer formed on the support. Examples of the photosensitive layer include a single layer type photosensitive layer in which a charge transport substance and a charge generating substance are contained in the same layer, and a lamination type (separate function type) photosensitive layer in which a charge-generating layer containing a charge generating substance is separated from a charge-transport layer containing a charge transport substance. In the present invention, the lamination type photosensitive layer is preferable. Alternatively, the charge-generating layer may have a lamination structure, or the charge-transport layer may have a lamination configuration. Moreover, to improve the durability of the electrophotographic photosensitive member, a protective layer may be formed on the photosensitive layer.

[Surface Layer]

In the electrophotographic photosensitive member according to the present invention, the "surface layer" means a layer below. Namely, when the charge-transport layer is the topmost surface, the charge-transport layer is the surface layer. When a protective layer is provided on the charge-transport layer, the protective layer is the surface layer.

In the electrophotographic photosensitive member according to the present invention, the surface layer therein contains a resin (α), a resin (β), and a compound (γ). The resin (α) is at least one resin selected from the group consisting of polycarbonate resins having no siloxane structure at a terminal and polyester resins having no siloxane structure at a terminal. The resin (β) is at least one resin selected from the group consisting of polycarbonate resins having a siloxane structure at a terminal, polyester resins having a siloxane structure at a terminal, and acrylic resins having a siloxane structure at a terminal. The compound (γ) is at least one compound selected from the group consisting of methyl benzoate, ethyl benzoate, benzyl acetate, ethyl 3-ethoxypropionate, and diethylene glycol ethyl methyl ether.

[Resin (α)]

In the resin (α), the polycarbonate resin having no siloxane structure at a terminal can be a polycarbonate resin A having a repeating structural unit represented by the following formula (A). The polyester resin having no siloxane structure at a terminal can be a polyester resin B having a repeating structural unit represented by the following formula (B).

(A)

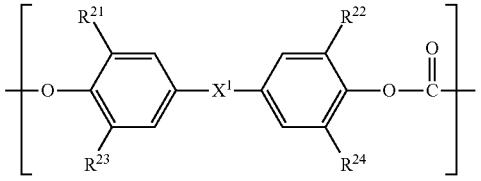

In the formula (A), $R^{21}$ to $R^{24}$ each independently represent a hydrogen atom or a methyl group; $X^1$ represents a single bond, a cyclohexylidene group, or a divalent group having a structure represented by the following formula (C).

(B)

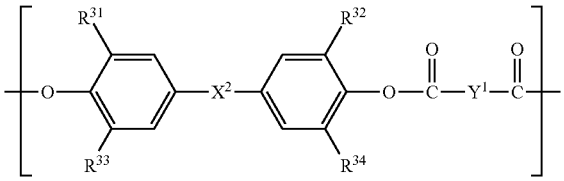

In the formula (B), $R^{31}$ to $R^{34}$ each independently represent a hydrogen atom or a methyl group; $X^2$ represents a single bond, a cyclohexylidene group, or a divalent group having a structure represented by the following formula (C); $Y^1$ represents an m-phenylene group, a p-phenylene group, or a divalent group in which two p-phenylene groups are bonded via an oxygen atom.

(C)

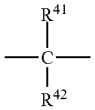

In the formula (C), $R^{41}$ and $R^{42}$ each independently represent a hydrogen atom, a methyl group, or a phenyl group.

Specific examples of a repeating structural unit in the polycarbonate resin A represented by the formula (A) are shown below:

(A-1)

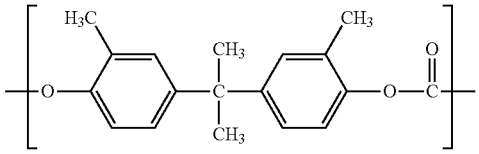

(A-2)

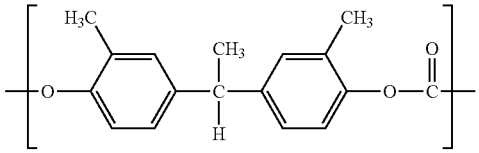

-continued (A-3)

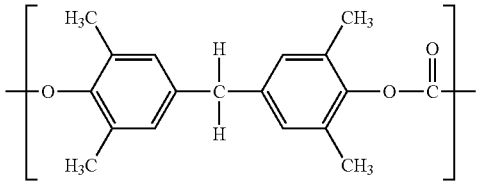

(A-4)

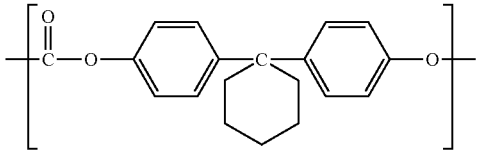

(A-5)

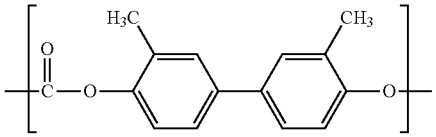

(A-6)

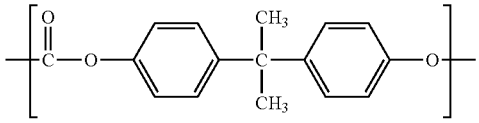

(A-7)

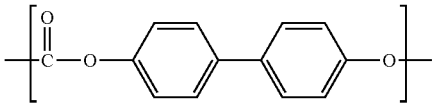

(A-8)

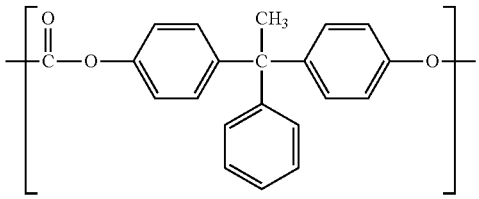

The polycarbonate resin A can be a polymer including only one kind of repeating structural unit selected from the repeating structural units represented by the above formulas (A-1) to (A-8), or a copolymer including two or more kinds of these repeating structural units. Among these repeating structural units, repeating structural units represented by the formulas (A-1), (A-2), and (A-4) are preferable.

Specific examples of a repeating structural unit in the polyester resin B represented by the formula (B) are shown below:

(B-1)

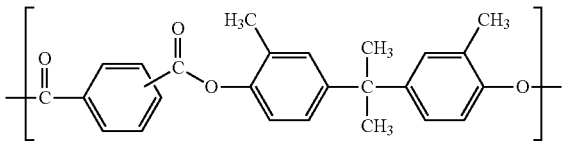

(B-2)

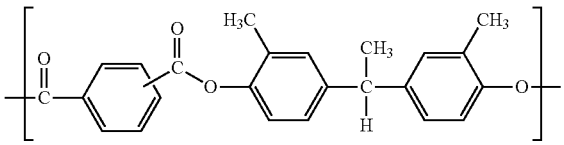

(B-3)

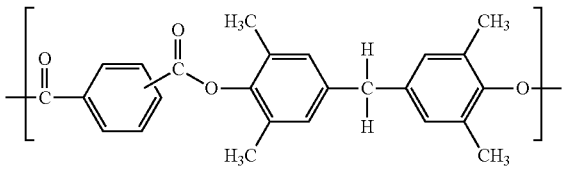

(B-4)

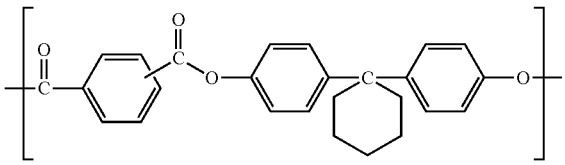

-continued (B-5)

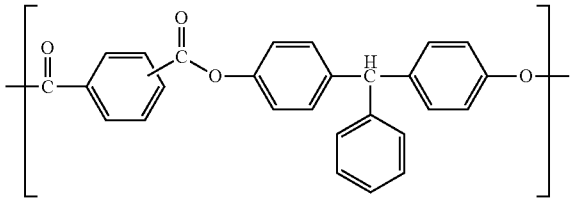

(B-6)

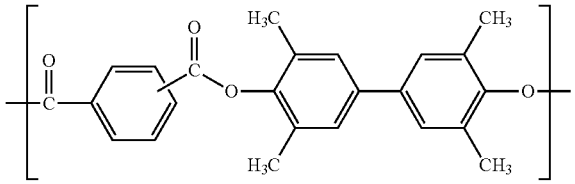

(B-7)

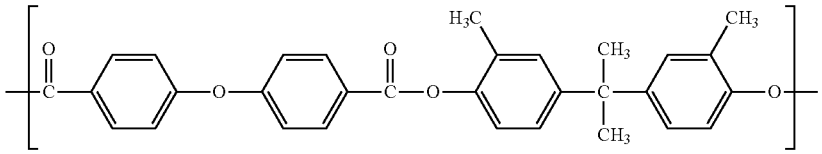

(B-8)

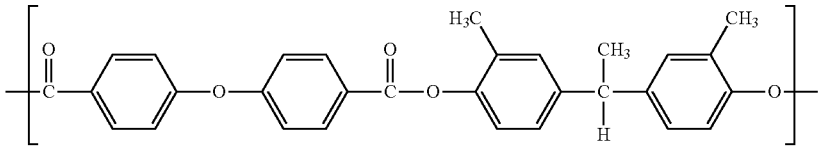

(B-9)

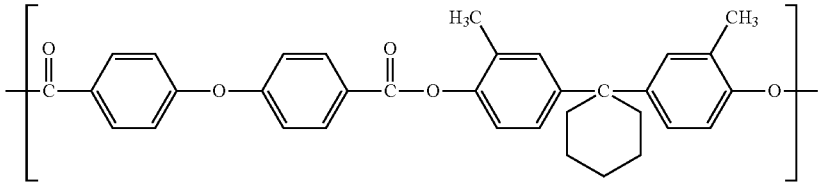

The polyester resin B can be a polymer including only one kind of repeating structural unit selected from the repeating structural units represented by the above formulas (B-1) to (B-9), or a copolymer including two or more kinds of repeating structural units above. Among these repeating structural units, repeating structural units represented by the formulas (B-1), (B-2), (B-3), (B-6), (B-7), and (B-8) are preferable.

The above polycarbonate resin A and the above polyester resin B can be synthesized by a known phosgene method, for example. Alternatively, these resins can be synthesized by transesterification. When the above polycarbonate resin A or polyester resin B is a copolymer, the form of copolymerization may be any of block copolymerization, random copolymerization, or alternating copolymerization. These polycarbonate resin A and polyester resin B can be synthesized by a known method. For example, these can be synthesized by methods described in Japanese Patent Application Laid-Open Nos. 2007-047655 and 2007-072277.

The mass average molecular weight of the polycarbonate resin A and that of the polyester resin B are preferably 20,000 or more and 300,000 or less, and more preferably 50,000 or more and 200,000 or less. In the present invention, the mass average molecular weight of the resin means a mass average molecular weight in terms of polystyrene according to the standard method in which the measurement is performed by the method described in Japanese Patent Application Laid-Open No. 2007-79555.

The polycarbonate resin A or polyester resin B as the resin (α) may be a copolymer having a repeating structural unit containing a siloxane structure in the main chain in addition to the repeating structural unit represented by the above formula (A) or the formula (B). Specifically, examples of such a repeating structural unit include repeating structural units represented by the following formula (H-1) or (H-2). Furthermore, these resins may have a repeating structural unit represented by the following formula (H-3).

(H-1)

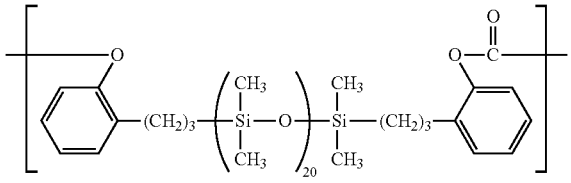

(H-2)

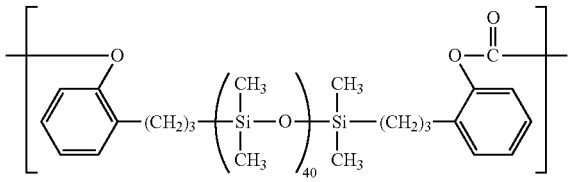

-continued (H-3)

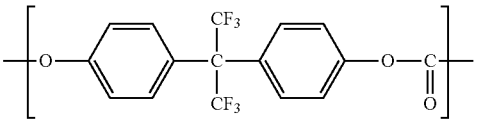

Specific resins used as the resin (α) will be shown below.

TABLE 1

| Resin (α) | Repeating structural unit | Ratio of repeating structural units (mass ratio) | Mass average molecular weight (Mw) |
|---|---|---|---|
| Resin A(1) | (A-4) | — | 55,000 |
| Resin A(2) | (A-4) | — | 14,000 |
| Resin A(3) | (A-4) | — | 110,000 |
| Resin A(4) | (A-6) | — | 55,000 |
| Resin A(5) | (A-1) | — | 54,000 |
| Resin A(6) | (A-6)/(A-1) | 6.5/3.5 | 55,000 |
| Resin A(7) | (A-4)/(H-1) | 9/1 | 55,000 |
| Resin A(8) | (A-4)/(H-1) | 9/1 | 110,000 |
| Resin A(9) | (A-4)/(H-1)/(H-3) | 6/1.5/2.5 | 60,000 |
| Resin B(1) | (B-1) | — | 120,000 |
| Resin B(2) | (B-1)/(B-6) | 7/3 | 120,000 |
| Resin B(3) | (B-8) | — | 100,000 |

In Table 1, in the repeating structural units represented by the above formulas (B-1) and (B-6) in the resin B(1) and the resin B(2), the molar ratio of a terephthalic acid structure to an isophthalic acid structure (terephthalic acid skeleton/isophthalic acid skeleton) is 5/5.

[Resin (β)]

The resin (β) is at least one resin selected from the group consisting of polycarbonate resins having a siloxane structure at a terminal, polyester resins having a siloxane structure at a terminal, and acrylic resins having a siloxane structure at a terminal. These resins (β) have high miscibility with the resin (α), keeping high mechanical durability of the surface layer in the electrophotographic photosensitive member. Since the resin (β) has a siloxane moiety at the terminal, the surface layer can attain high lubrication, and the initial friction coefficient of the surface layer can be reduced. It is supposedly because that when the resin (β) has a siloxane moiety at the terminal, the siloxane portion has increased freedom to raise the probability that the resin (β) migrates to the surface portion of the surface layer; as a result, the resin (β) is likely to exist in the surface of the electrophotographic photosensitive member.

In the present invention, the polycarbonate resin having a siloxane structure at a terminal can be a polycarbonate resin A' having a repeating structural unit represented by the following formula (A') and a terminal structure represented by the following formula (D). Moreover, the polyester resin having a siloxane structure at a terminal can be a polyester resin B' having a repeating structural unit represented by the following formula (B') and a terminal structure represented by the following formula (D).

(A')

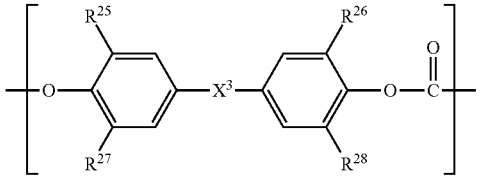

In the formula (A'), $R^{25}$ to $R^{28}$ each independently represent a hydrogen atom or a methyl group; $X^3$ represents a single bond, a cyclohexylidene group, or a divalent group having a structure represented by the following formula (C').

(B')

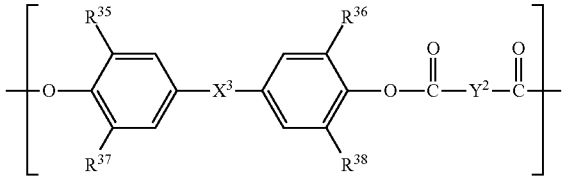

In the formula (B'), $R^{35}$ to $R^{38}$ each independently represent a hydrogen atom or a methyl group; $X^4$ represents a single bond, a cyclohexylidene group, or a divalent group having a structure represented by the following formula (C'); $Y^2$ represents an m-phenylene group, a p-phenylene group, or a divalent group in which two p-phenylene groups are bonded via an oxygen atom.

(C')

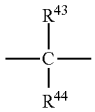

In the formula (C'), $R^{43}$ and $R^{44}$ each independently represent a hydrogen atom, a methyl group, or a phenyl group.

(D)

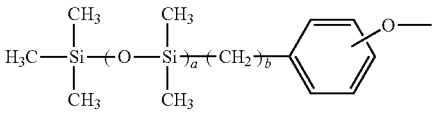

In the formula (D), a and b represent the repetition number of the structure unit within the brackets, the average value of a is 20 or more and 100 or less, and the average value of b is 1 or more and 10 or less. More preferably, the average value of a is 30 or more and 60 or less, and the average value of b is 3 or more and 10 or less.

In the present invention, the polycarbonate resin A' and the polyester resin B' have a terminal structure represented by the above formula (D) at one terminal or both terminals of the resin. When the resin has the terminal structure represented by the above formula (D) at one terminal thereof, a molecular weight adjusting agent (terminal agent) is used. Examples of the molecular weight adjusting agent include phenol, p-cumylphenol, p-tert-butylphenol, or benzoic acid. In the present invention, phenol or p-tert-butylphenol is preferable.

When the resin has the terminal structure represented by the above formula (D) at one terminal, the structure of the other terminal (the other terminal structure) is a structure represented by the following formula (G-1) or (G-2):

(G-1)

(G-2)

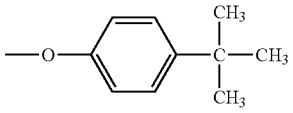

Specific examples of the terminal siloxane structure represented by formula (D) will be shown below:

(D-1)

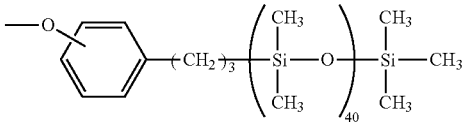

(D-2)

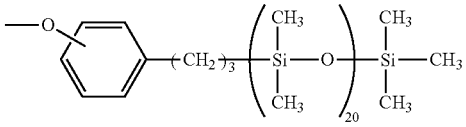

(D-3)

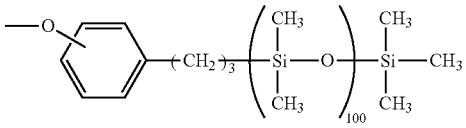

(D-4)

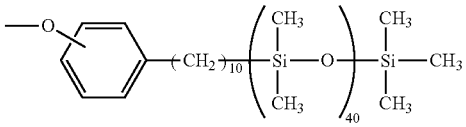

(D-5)

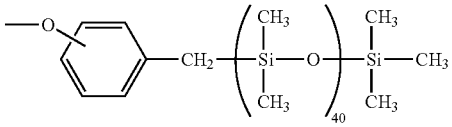

In the polycarbonate resin A', specific examples of the repeating structural unit represented by the formula (A') include repeating structural units represented by the above formulas (A-1) to (A-8). The repeating structural units represented by the above formulas (A-1), (A-2), and (A-4) are preferable. In the polyester resin B', specific examples of the repeating structural unit represented by the formula (B') include repeating structural units represented by the above formulas (B-1) to (B-9). The repeating structural units represented by the above formulas (B-1), (B-2), (B-3), (B-6), (B-7), and (B-8) are preferable. Among these, the repeating structural units represented by the formulas (B-1) and (B-3) are particularly preferable.

When the polycarbonate resin A' or polyester resin B' is a copolymer, the form of copolymerization may be any of block copolymerization, random copolymerization, and alternating copolymerization. The polycarbonate resin A' or the polyester resin B' may have a repeating structural unit having a siloxane structure in the main chain. Examples of the resin include copolymers having a repeating structural unit represented by the following formula (H).

(H)

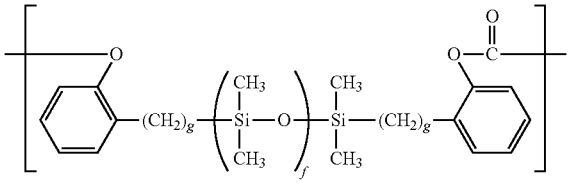

In the formula (H), f and g represent the repetition number of the structure unit within the brackets, the average value of f is 20 or more and 100 or less, and the average value of g is 1 or more and 10 or less. Specific examples of the repeating structural unit represented by the formula (H) include repeating structural units represented by the above formula (H-1) or (H-2).

In the present invention, the "siloxane moiety" in the polycarbonate resin A' or polyester resin B' refers to a portion surrounded by the dotted lines in the terminal structure represented by the following formula (D-S). Furthermore, when the polycarbonate resin A' or polyester resin B' has the repeating structural unit represented by the formula (H), the siloxane moiety includes the structure surrounded by the dotted lines in the repeating structure represented by the following formula (H-S).

(D-S)

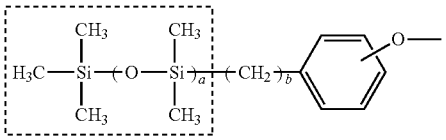

(H-S)

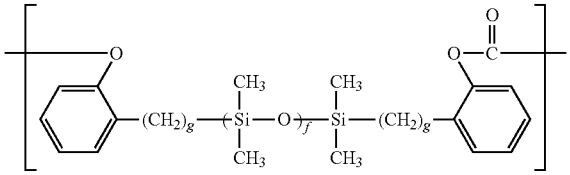

In the present invention, the polycarbonate resin A' and the polyester resin B' can be synthesized by a known method. For example, these resins can be synthesized by the method described in Japanese Patent Application Laid-Open No. 2007-199688. In the present invention, using the same synthesis method and raw materials according to the polycarbonate resin A' and the polyester resin B', the polycarbonate resin A' and polyester resin B' shown in Synthesis Examples in Table 2 can be synthesized. The composition of the polycarbonate resin A' and that of the polyester resin B' can be identified as follows: after the resin is fractioned and separated using size exclusion chromatography, the fractioned components are measured by $^{1}$H-NMR, and the relative ratio of the above siloxane moiety in the resin is determined. In the synthesized polycarbonate resin A' and polyester resin B', the mass average molecular weight and the content of the siloxane moiety are shown in Table 2.

Specific examples of the polycarbonate resin A' and the polyester resin B' are shown below.

TABLE 2

| Resin (β) | Repeating structural unit in main chain | Terminal siloxane structure | Other terminal structure | Content of siloxane moiety (% by mass) | Mass average molecular weight (Mw) |
|---|---|---|---|---|---|
| Resin A' (1) | (A-4) | (D-1) | — | 23 | 50,000 |
| Resin A' (2) | (A-2) | (D-5) | — | 25 | 48,000 |
| Resin A' (3) | (A-4)/(H-2) | (D-1) | — | 32 | 54,000 |
| Resin A' (4) | (A-4) | (D-1) | (G-2) | 12 | 49,000 |
| Resin B' (1) | (B-1) | (D-1) | — | 22 | 42,000 |

In Table 2, in the resin A'(3), the mass ratio (A-4)/(H-2) of the repeating structural units in the main chain is 9/1.

In the present invention, the acrylic resin having a siloxane structure at a terminal can be an acrylic resin F having at least one repeating structural unit selected from the group consisting of repeating structural units represented by the following formulas (F-1), (F-2), and (F-3).

(F-1)

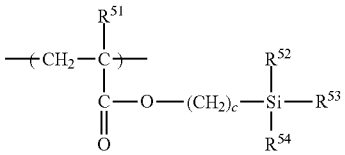

In the formula (F-1), $R^{51}$ represents hydrogen or a methyl group; c represents the repetition number of the structure unit within the brackets, and the average value of c is 0 or more and 5 or less; $R^{52}$ to $R^{54}$ each independently represent a structure represented by the following formula (F-1-2), a methyl group, a methoxy group, or a phenyl group; at least one of $R^{52}$ to $R^{54}$ have a structure represented by the following formula (F-1-2).

(F-1-2)

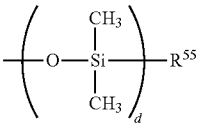

In the formula (F-1-2), d represents the repetition number of the structure unit within the brackets, the average value of d is 10 or more and 50 or less; $R^{55}$ represents a hydroxyl group or a methyl group.

(F-2)

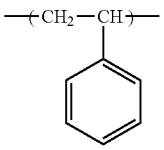

(F-3)

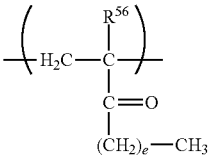

In the formula (F-3), $R^{56}$ represents hydrogen, a methyl group, or a phenyl group; e represents 0 or 1.

In the present invention, the "siloxane moiety" in the acrylic resin F refers to a portion surrounded by the dotted lines in the structure represented by the following formula (F-S) or (F-T):

(F-S)

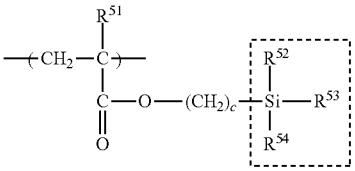

(F-T)

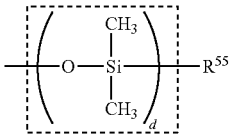

Specific examples of the repeating structural unit in the acrylic resin F are shown in Table 3 below.

TABLE 3

| Compound Example | (F-1) | (F-2) or (F-3) | Mass ratio of repeating structural units | Mass average molecular weight (Mw) |
|---|---|---|---|---|
| F-A | 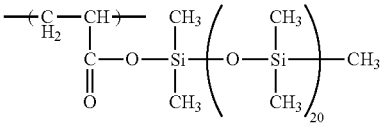 | 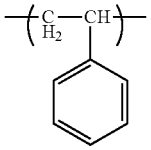 | 2/8 | 105000 |
| F-B | 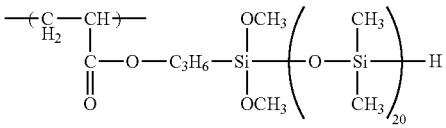 | 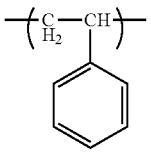 | 2/8 | 100000 |

TABLE 3-continued

| Compound Example | (F-1) | (F-2) or (F-3) | Mass ratio of repeating structural units | Mass average molecular weight (Mw) |
|---|---|---|---|---|
| F-C | 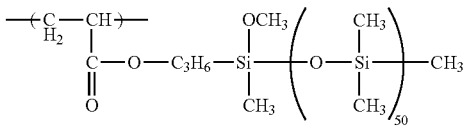 | 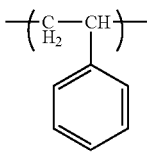 | 1/9 | 100000 |
| F-D | 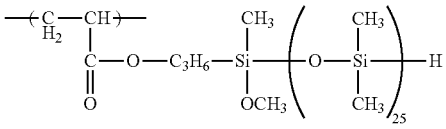 | 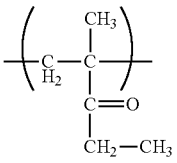 | 1/9 | 105000 |
| F-E | 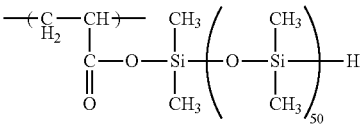 | 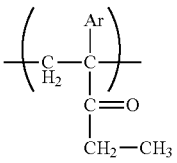 | 2/8 | 110000 |
| F-F | 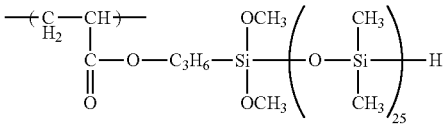 | 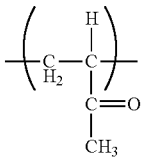 | 1.5/8.5 | 100000 |
| F-G | 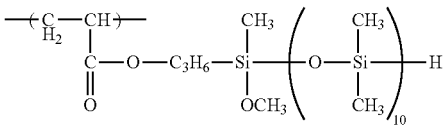 | 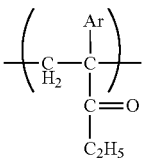 | 1/9 | 110000 |

Among the acrylic resin F shown in above Table 3, resins represented by Compound Examples (F-B) and (F-E) are preferable. These acrylic resins can be synthesized by a known method such as the methods described in Japanese Patent Application Laid-Open Nos. S58-167606 and S62-75462.

From the viewpoint of reduction in the initial friction coefficient of the surface layer and suppression in fluctuation of the bright potential in repeated use, the content of the resin (β) in the surface layer in the electrophotographic photosensitive member can be 0.1% by mass or more and 50% by mass or less based on the mass of the resin (α). At a content of the resin (β) within the above range, the compound (γ) in the surface layer has increased freedom to easily polarize. For this reason, an effect of improving the grip properties to the charging member is exhibited.

[Compound (γ)]

The surface layer in the electrophotographic photosensitive member according to the present invention contains at least one compound selected from the group consisting of methyl benzoate, ethyl benzoate, benzyl acetate, ethyl 3-ethoxypropionate, and diethylene glycol ethyl methyl ether as the compound (γ).

Since the surface layer contains these compounds, the electrophotographic photosensitive member attains effects of stability of the potential in repeated use of the electrophotographic photosensitive member and suppression in a slip between the charging member and the electrophotographic photosensitive member. The content of the compound (γ) can be 0.001% by mass or more and 0.5% by mass or less based on the total mass of the surface layer. At a content of the compound (γ) within this range, reduction in the initial friction coefficient of the surface layer and stability of the potential in repeated use of the electrophotographic photosensitive member are met at the same time, and resistance to wear is enhanced. Additionally, the compound (γ) polarizes within the surface layer in formation of an image to attain an effect of improving grip properties to the charging member.

In the present invention, the compound (γ) is contained in a coating solution for a surface layer. The coating solution for a surface layer is applied onto the support, and heat dried to form a coating. Thus, the surface layer containing the compound (γ) is formed. The compound (γ) easily volatizes during the heat drying step in formation of the surface layer. For this reason, the content (% by mass) of the compound (γ) in the coating solution for a surface layer can be larger than the content (% by mass) of the compound (γ) in the surface layer. Accordingly, the content of the compound (γ) in the coating solution for a surface layer can be 5% by mass or more and 80% by mass or less based on the total mass of the coating solution for a surface layer.

The content of the compound (γ) in the surface layer can be determined by the measurement method described below. The measurement is performed using an HP7694 Headspace sampler (made by Agilent Technologies, Inc.) and an HP6890 series GS System (made by Agilent Technologies, Inc.). A sample piece having a size of 5 mm×40 mm and including the surface layer is cut from the produced electrophotographic photosensitive member. This sample piece is placed into a vial. The Headspace sampler (HP7694 Headspace sampler) is set as follows: Oven: 150° C., Loop: 170° C., and Transfer Line: 190° C. The gas that generates from the sample piece is measured by a gas chromatograph (HP6890 series GS System).

The mass of the surface layer in the sample piece is measured as follows. First, the mass of the sample piece used in the above measurement is weighed. Here, the mass of the compound (γ) that volatizes from the surface layer in the measurement with the above gas chromatograph is considered to allow to be neglected. Next, the sample piece is immersed in methyl ethyl ketone for 5 minutes to remove the surface layer, and dried at 100° C. for 5 minutes. The mass of the sample piece obtained after removal of the surface layer is weighed. From the difference between these masses, the mass of the surface layer that the sample piece has is determined. Thus, the content of the compound (γ) in the surface layer is measured.

[Support]

The support in the electrophotographic photosensitive member is an electro-conductive support. Examples of the support include those made of metals such as aluminum, stainless steel, copper, nickel, and zinc or alloys thereof. In the case of the supports made of aluminum or an aluminum alloy, ED tubes, EI tubes, and those subjected to machining, electrochemical mechanical polishing (electrolysis using an electrode having electrolysis action and an electrolyte solution and polishing with a grinding wheel having polishing action), or wet or dry honing can also be used. Examples of the support also include metal supports and resin supports having a thin film thereon, the thin film being made of a conductive material such as aluminum, an aluminum alloy, or an indium oxide-tin oxide alloy.

Moreover, supports prepared by impregnating a conductive particle such as carbon black, a tin oxide particle, a titanium oxide particle, and a silver particle with a resin, and plastics containing a conductive binder resin can be used.

The surface of the electro-conductive support may be subjected to machining, surface roughening, or an anodized aluminum treatment in order to prevent interference fringes caused by scattering of laser light or the like.

[Electrically Conductive Layer]

In the electrophotographic photosensitive member according to the present invention, an electrically conductive layer containing a conductive particle and a resin may be provided on the support. The electrically conductive layer is a layer formed using a coating solution for an electrically conductive layer prepared by dispersing a conductive particle in a binder resin.

Examples of the conductive particle include carbon black and acetylene black; metal powders such as aluminum, nickel, iron, nichrome, copper, zinc, and silver; metal oxide powders such as conductive tin oxide and ITO.

Examples of the binder resin used in the electrically conductive layer include polyester resins, polycarbonate resins, polyvinyl butyral resins, acrylic resins, silicone resins, epoxy resins, melamine resins, urethane resins, phenol resins, and alkyd resins.

Examples of the solvent used in the coating solution for an electrically conductive layer include ether solvents, alcohol solvents, ketone solvents, and aromatic hydrocarbon solvents. The layer thickness of the electrically conductive layer is preferably 0.2 μm or more and 40 μm or less, more preferably 1 μm or more and 35 μm or less, and still more preferably 5 μm or more and 30 μm or less.

[Intermediate Layer]

An intermediate layer may be provided between the electro-conductive support or electrically conductive layer and the photosensitive layer. The intermediate layer is formed for improvement in the adhesiveness of the photosensitive layer, applicability, and charge injection properties from the electro-conductive support and protection of the photosensitive layer against electrical breakdown. The intermediate layer can be formed by applying a coating solution for an intermediate layer containing a binder resin onto the support or electrically conductive layer, and drying or curing the coating solution.

Examples of the binder resin used in the intermediate layer include polyacrylic acids, methyl cellulose, ethyl cellulose, polyamide resins, polyimide resins, polyamidimide resins, polyamic acid resins, melamine resins, epoxy resins, and polyurethane resins. The binder resin used in the intermediate layer can be thermoplastic resins, and specifically thermoplastic polyamide resins. The polyamide resins can be low crystalline or non-crystalline copolymerized nylons applicable in a liquid state.

Examples of the solvent used in the coating solution for an intermediate layer include ether solvents, alcohol solvents, ketone solvents, and aromatic hydrocarbon solvents. The layer thickness of the intermediate layer is preferably 0.05 μm or more and 40 μm or less, and more preferably 0.1 μm or more and 30 μm or less. The intermediate layer may also contain a semiconductive particle, an electron transport substance, or an electron accepting substance.

[Photosensitive Layer]

A photosensitive layer (charge-generating layer, charge-transport layer) is formed on the electro-conductive support, electrically conductive layer, or intermediate layer. The charge-generating layer can be formed by applying a coating solution for a charge-generating layer prepared by dispersing a charge generating substance with a binder resin and a solvent, and drying the coating solution. The charge-generating layer may also be a deposition film of the charge generating substance.

Examples of the charge generating substance include azo pigments, phthalocyanine pigments, indigo pigments, and perylene pigments. These charge generating substances may be used alone or in combination of two or more. Among these, particularly oxytitanium phthalocyanine, hydroxygallium phthalocyanine, and chlorogallium phthalocyanine are preferable for their high sensitivity.

Examples of the binder resin used in the charge-generating layer include polycarbonate resins, polyester resins, butyral resins, polyvinyl acetal resins, acrylic resins, vinyl acetate resins, urea resins, and copolymerized resins prepared by copolymerizing monomers that are raw materials for these resins. Among these, butyral resins are particularly preferable. These resins can be used alone or in combination of two or more.

Examples of the dispersing method include methods using a homogenizer, an ultrasonic, a ball mill, a sand mill, an Attritor, or a roll mill. For the proportion of the charge generating substance to the binder resin, the charge generating substance is in the range of preferably 0.1 parts by mass or more and 10 parts by mass or less, and more preferably 1 part by mass or more and 3 parts by mass or less based on 1 part by mass of the binder resin. Examples of the solvent used in the coating solution for a charge-generating layer include alcohol solvents, sulfoxide solvents, ketone solvents, ether solvents, ester solvents, and aromatic hydrocarbon solvents.

The layer thickness of the charge-generating layer is preferably 0.01 μm or more and 5 μm or less, and more preferably 0.1 μm or more and 2 μm or less.

The charge-generating layer may contain a variety of sensitizers, antioxidants, ultraviolet absorbing agents, and plasticizers when necessary. To prevent a flow of charges (carriers) from stagnating in the charge-generating layer, the charge-generating layer may contain an electron transport substance or an electron accepting substance.

In the electrophotographic photosensitive member including a lamination type photosensitive layer, a charge-transport layer is provided on the charge-generating layer. The charge-transport layer can be formed by applying a coating solution for a charge-transport layer prepared by dissolving a charge transport substance and a binder resin in a solvent, and drying the coating solution. Examples of the charge transport substance include triarylamine compounds, hydrazone compounds, styryl compounds, and stilbene compounds. The charge transport substance can be compounds represented by the following structure formulas (CTM-1) to (CTM-7).

(CTM-1)

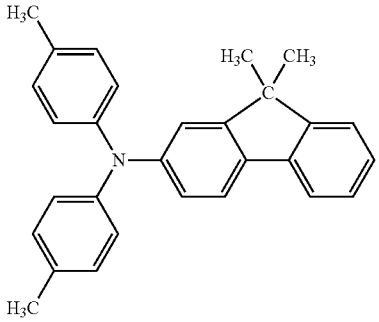

(CTM-2)

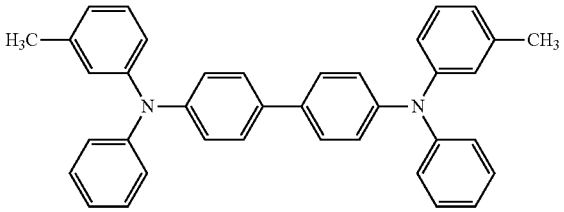

(CTM-3)

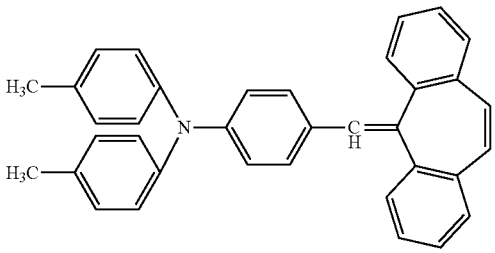

(CTM-4)

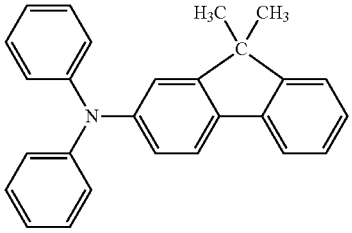

-continued (CTM-5)

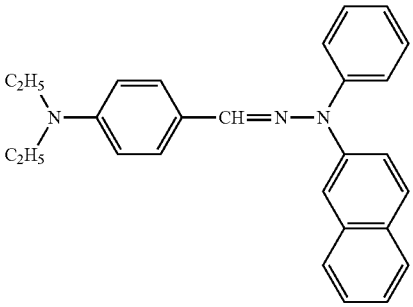

(CTM-6)

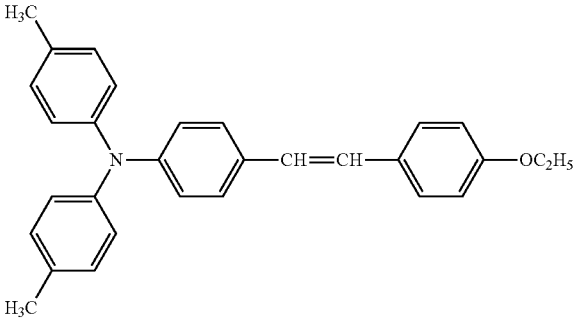

(CTM-7)

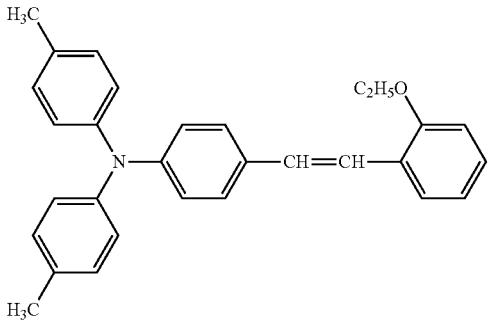

In the present invention, when the charge-transport layer is the surface layer, the binder resin contains the resin (α) and the resin (β). Another resin may be further mixed and used. The other resin that may be mixed and used are as described above.

The layer thickness of the charge-transport layer is preferably 5 to 50 μm, and more preferably 10 to 30 μm. The mass ratio of the charge transport substance to the binder resin is preferably 5:1 to 1:5, and more preferably 3:1 to 1:3.

Examples of the solvent used in the coating solution for a charge-transport layer include alcohol solvents, sulfoxide solvents, ketone solvents, ether solvents, ester solvents, and aromatic hydrocarbon solvents. The solvent can be xylene, toluene, and tetrahydrofuran.

[Production of Electrophotographic Photosensitive Member]

A variety of additives can be added to the layers in the electrophotographic photosensitive member according to the present invention. Examples of the additives include degradation preventing agents such as an antioxidant, an ultraviolet absorbing agent, and a light stabilizer, organic fine particles, and inorganic fine particles. Examples of the degradation preventing agents include hindered phenol antioxidants, hindered amine light stabilizers, sulfur atom-containing antioxidants, and phosphorus atom-containing antioxidants. Examples of the organic fine particles include high molecule resin particles such as fluorine atom-containing resin particles, polystyrene fine particles, and polyethylene resin particles. Examples of the inorganic fine particles include metal oxides such as silica and alumina.

When the above coating solutions for the layers are applied, an application method such as an immersion coating method, a spray coating method, a spinner coating method, a roller coating method, a Meyer bar coating method, or a blade coating method can be used. Among these, the immersion coating method is preferable.

The drying temperature when the above coating solutions for the layers are dried to form a coating can be preferably 60° C. or more and 150° C. or less. Among these, the drying temperature of the coating solution for a charge-transport layer (coating solution for a surface layer) is particularly preferably 110° C. or more and 140° C. or less. The drying time is preferably 10 to 60 minutes, and more preferably 20 to 60 minutes.

<Charging Member>

The charging member according to the present invention includes an electro-conductive substrate and an electroconductive resin layer formed on the electro-conductive substrate. The electroconductive resin layer contains a binder, a conductive fine particle, and a bowl-shaped resin particle having an opening. The surface of the charging member has a concavity derived from the opening of the bowl-shaped resin particle and a protrusion derived from the edge of the opening of the bowl-shaped resin particle. The charging member can have a roller shape, a flat plate shape, or a belt shape, for example. With reference to the charging roller illustrated in FIGS. 1A and 1B, the configuration of the charging member according to the present invention will be described below.

Figure 1B:
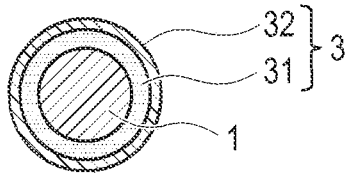
FIG. 1B is a sectional view of another charging member according to the present invention (in a form of a roller).

The charging roller illustrated in FIG. 1A includes an electro-conductive substrate 1 and an electroconductive resin layer 3. The circumferential surface of the electro-conductive substrate 1 is coated with the electroconductive resin layer 3. The electroconductive resin layer 3 contains a binder, a conductive fine particle, and a bowl-shaped resin particle. As illustrated in FIG. 1B, the electroconductive resin layer 3 may be formed of a first electroconductive resin layer 31 and a second electroconductive resin layer 32.

The electro-conductive substrate may be bonded to a layer disposed immediately on the electro-conductive substrate with an adhesive. In this case, the adhesive can have conductivity. To give conductivity, a known conductive agent can be contained in the adhesive. Examples of the binder for the adhesive include thermosetting resins and thermoplastic resins. Known binders such as urethane binders, acrylic binders, polyester binders, polyether binders, and epoxy binders can be used. The conductive agent for giving conductivity to the adhesive can be properly selected from conductive fine particles and ionic conduction agents described later, and used alone or in combination of two or more.

For better charging of the electrophotographic photosensitive member, the charging member usually has an electric resistance value of more preferably $1\times10^{3}\Omega$ or more and $1\times10^{10}\Omega$ or less in an environment of a temperature of 23° C. and a relative humidity of 50%. From the viewpoint of a uniform nip width in the longitudinal direction with respect to the electrophotographic photosensitive member, the charging member can have a crown shape in which the central portion in the longitudinal direction of the charging member is the thickest and the thickness of the charging member reduces toward the ends in the longitudinal direction. The crown amount (the average value of the differences between the outer diameter of the central portion and the outer diameters 90 mm spaced from the central portion toward the ends) can be 30 μm or more and 200 μm or less. The hardness of the surface of the charging member is preferably 90° or less, and more preferably 40° or more and 80° or less measured with a microdurometer (MD-1 type). At a hardness within this range, the charging member can be more surely brought into contact with the electrophotographic photosensitive member.

[Concavity and Protrusion Structure of Surface of Charging Member]

Figure 2A:
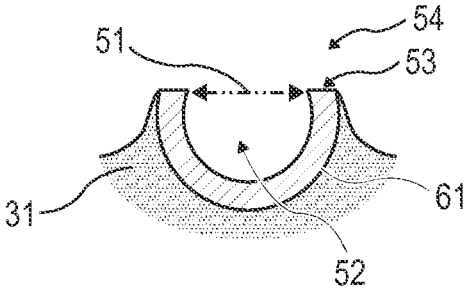
FIG. 2A is a partial sectional view in the vicinity of the surface of the charging member according to the present invention.
Figure 2B:
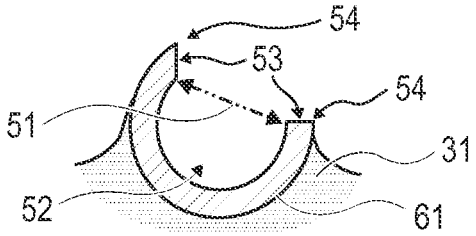
FIG. 2B is a partial sectional view in the vicinity of the surface of another charging member according to the present invention.

FIGS. 2A and 2B are partial sectional views illustrating a surface portion of the electroconductive resin layer in the charging member. In these charging members, a bowl-shaped resin particle 61 is exposed in the surface of the charging member. The surface of the charging member has a concavity derived from an opening 51 of the bowl-shaped resin particle exposed in the surface and a protrusion 54 derived from an edge 53 of the opening of the bowl-shaped resin particle exposed in the surface.

Here, the "bowl-shaped resin particle" in the present invention refers to a particle having a resin shell, the opening 51 derived from the partial lack of the shell, and a spherical concavity 52. The thickness of the shell can be within the range of 0.1 to 3 micrometers (μm). The shell can have a substantially uniform thickness. The substantially uniform thickness means that for example, the thickness of the thickest portion of the shell is 3 times or less, and preferably twice or less the thickness of the thinnest portion of the shell. Examples of the bowl-shaped resin particle are illustrated in FIGS. 4A to 4E.

Figure 4A:
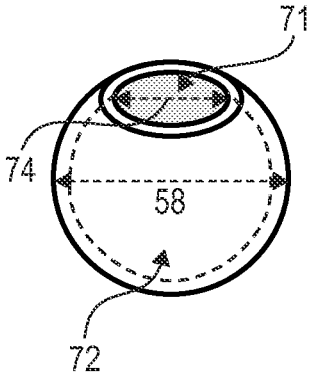
FIG. 4A is a diagram for describing a shape of a bowl-shaped resin particle used in the present invention.
Figure 4B:
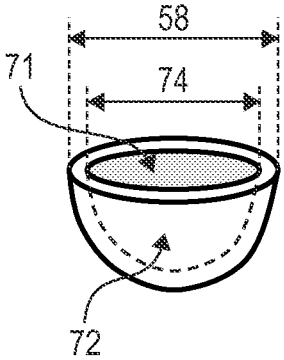
FIG. 4B is a diagram for describing a shape of another bowl-shaped resin particle used in the present invention.
Figure 4C:
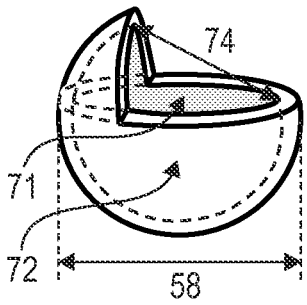
FIG. 4C is a diagram for describing a shape of another bowl-shaped resin particle used in the present invention.
Figure 4D:
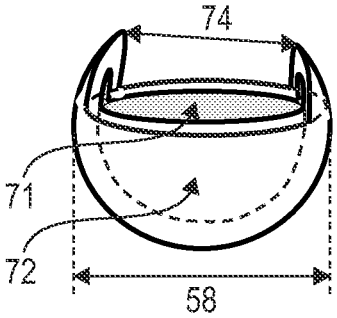
FIG. 4D is a diagram for describing a shape of another bowl-shaped resin particle used in the present invention.
Figure 4E:
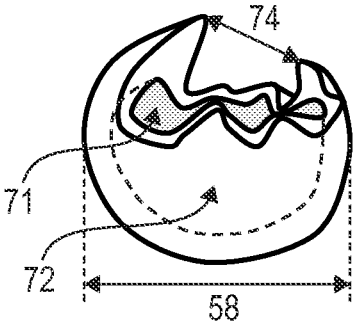
FIG. 4E is a diagram for describing a shape of another bowl-shaped resin particle used in the present invention.

The opening 51 may have a flat edge as illustrated in FIGS. 4A and 4B. Alternatively, the edge of the opening 51 may have a concavity and a protrusion as illustrated in FIG. 4C, 4D, or 4E. The largest diameter 58 of the bowl-shaped resin particle is 5 μm or more and 150 μm or less, and particularly preferably 8 μm or more and 120 μm or less. At a largest diameter within this range, the charging member can be more surely brought into contact with the electrophotographic photosensitive member.

Figure 2C:
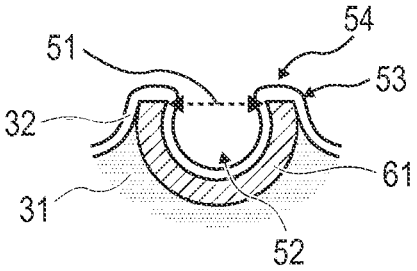
FIG. 2C is a partial sectional view in the vicinity of the surface of another charging member according to the present invention.
Figure 2D:
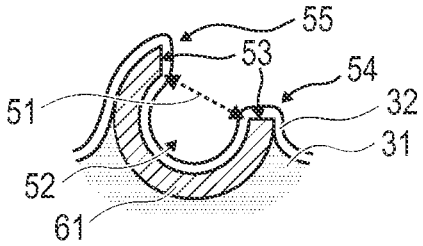
FIG. 2D is a partial sectional view in the vicinity of the surface of another charging member according to the present invention.

FIGS. 2C and 2D are partial sectional views illustrating the surface portions of the electroconductive resin layers in the charging members, the electroconductive resin layers each being formed of the first electroconductive resin layer 31 and the second electroconductive resin layer 32. In these charging members, the bowl-shaped resin particle 61 exists without being exposed in the surface of the charging member. More specifically, the bowl-shaped resin particle 61 exists such that the opening is exposed in the surface of the first electroconductive resin layer 31 and the edge 53 of the opening configures the protrusion. The second electroconductive resin layer (thin layer) 32 is formed along the inner wall of the spherical concavity 52 of the bowl-shaped resin particle 61. As a result, the surface of the charging member has a concavity derived from the opening of the bowl-shaped resin particle. Furthermore, the edge 53 of the opening 51 is coated with the second electroconductive resin layer (thin layer). As a result, the surface of the charging member has a protrusion 54 derived from the edge.

As a result of intensive research by the present inventors, it was found that in the charging member including the electroconductive resin layer containing the bowl-shaped resin particle and having the "concavity derived from the opening of the bowl-shaped resin particle" and the "protrusion derived from the edge of the opening" in the surface of the charging member, the charging member attains charging performance identical to that of the charging member having a protrusion derived from the conventional conductive resin particle even in long-term use. Furthermore, it was found that the protrusion derived from the edge of the opening elastically deforms better than the protrusion derived from the conventional conductive resin particle when the charging member is brought into contact with the electrophotographic photosensitive member.

Figure 8A:
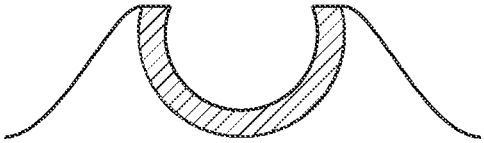
FIG. 8A is an enlarged view in the vicinity of a contact region between the charging member according to the present invention and the electrophotographic photosensitive member according to the present invention.
Figure 8B:
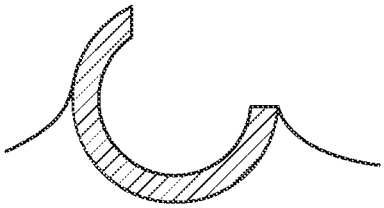
FIG. 8B is an enlarged view in the vicinity of a contact region between another charging member according to the present invention and the electrophotographic photosensitive member according to the present invention.
Figure 8C:
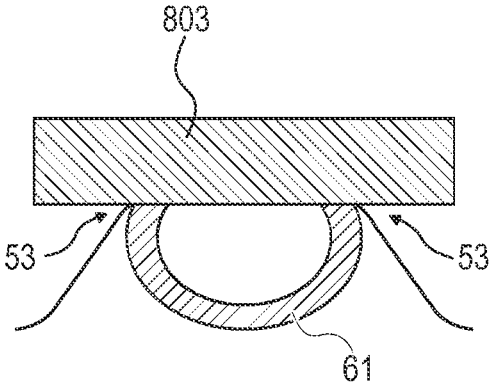
FIG. 8C is an enlarged view in the vicinity of a contact region between another charging member according to the present invention and the electrophotographic photosensitive member according to the present invention.
Figure 8D:
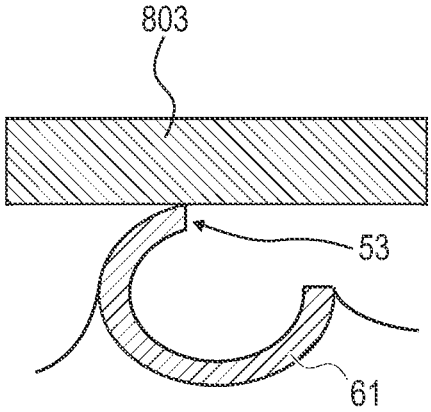
FIG. 8D is an enlarged view in the vicinity of a contact region between another charging member according to the present invention and the electrophotographic photosensitive member according to the present invention.

FIGS. 8A and 8B are diagrams each illustrating the state of the charging member having the concavity and the protrusion illustrated in FIGS. 2A and 2B before the charging member contacts the electrophotographic photosensitive member. FIGS. 8C and 8D are diagrams each illustrating the state of the nip when the charging member having the concavity and the protrusion illustrated in FIGS. 2A and 2B contacts the electrophotographic photosensitive member. It was observed that the edge 53 of the opening of the bowl-shaped resin particle 61 elastically deforms by the contact pressure between the electrophotographic photosensitive member 803 and the charging member. It is presumed that the elastic deformation enhances the grip force of the charging member to the electrophotographic photosensitive member to stabilize the contact state between the charging member and the electrophotographic photosensitive member.

Figure 3:
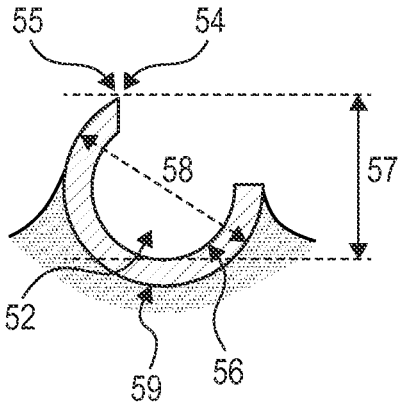
FIG. 3 is a partial sectional view in the vicinity of the surface of the charging member according to the present invention.

The height difference 57 between a vertex 55 of the protrusion 54 derived from the edge of the opening of the bowl-shaped resin particle and a bottom 56 of a round concavity 52 of the bowl-shaped resin particle illustrated in FIG. 3 is 5 μm or more and 100 μm or less, and particularly preferably 8 μm or more and 80 μm or less. At a height difference within this range, the charging member can be more surely brought into contact with the electrophotographic photosensitive member. The ratio of the largest diameter 58 of the bowl-shaped resin particle to the height difference 57, namely, [largest diameter]/[height difference] can be 0.8 or more and 3.0 or less. At a height difference within this range, the charging member can be more surely brought into contact with the electrophotographic photosensitive member.

Formation of the concavity and the protrusion can lead to control of the state of the surface of the electroconductive resin layer as follows. The ten-point average roughness (Rzjis) can be 5 μm or more and 65 μm or less. At an Rzjis within this range, the charging member can be more surely brought into contact with the electrophotographic photosensitive member. The average interval between the concavity and the protrusion of the surface (Sm) is 20 μm or more and 200 μm or less, and particularly preferably 30 μm or more and 150 μm or less. At an Sm within this range, the average interval between the concavity and the protrusion is short, the contact point of the charging member and the electrophotographic photosensitive member will increase, polarization of the compound (γ) contained in the electrophotographic photosensitive member is easily induced to enhance the electrostatic attraction between the electrophotographic photosensitive member and the protrusions of the charging member. As a result, the charging member can be more surely brought into contact with the electrophotographic photosensitive member. The method for measuring the ten-point average roughness (Rzjis) of the surface and the average interval (Sm) between the concavity and the protrusion of the surface will be described later in detail.

The ratio of the largest diameter 58 of the bowl-shaped resin particle to the smallest diameter 74 of the opening, namely, [largest diameter of bowl-shaped resin particle]/[smallest diameter of opening] can be 1.1 or more and 4.0 or less. Thereby, the charging member can be more surely brought into contact with the electrophotographic photosensitive member.

[Electroconductive Resin Layer]

[Binder]

For the binder contained in the electroconductive resin layer in the charging member, a known rubber or resin can be used. Examples of rubber can include natural rubber, vulcanized natural rubber, and synthetic rubber. Examples of the synthetic rubber include: ethylene propylene rubber, styrene butadiene rubber (SBR), silicone rubber, urethane rubber, isoprene rubber (IR), butyl rubber, acrylonitrile butadiene rubber (NBR), chloroprene rubber (CR), acrylic rubber, epichlorohydrin rubber, and fluorine rubber. For the resin, resins such as thermosetting resins and thermoplastic resins can be used. Among these, fluorine resins, polyamide resins, acrylic resins, polyurethane resins, acrylic urethane resins, silicone resins, and butyral resins are more preferable. By use of the above materials, the charging member can be more surely brought into contact with the electrophotographic photosensitive member. These may be used alone or in a mixture of two or more. The monomers that are raw materials for these binders may be copolymerized to prepare copolymers.

When the electroconductive resin layer is formed of the first electroconductive resin layer and the second electroconductive resin layer, the rubber can be used for the binder used in the first electroconductive resin layer. The reason is that the charging member can be more surely brought into contact with the electrophotographic photosensitive member. When the rubber is used for the binder used in the first electroconductive resin layer, the resin can be used for the binder in the second electroconductive resin layer. The reason is that the adhesion and friction properties between the charging member and the electrophotographic photosensitive member can be controlled more easily. The electroconductive resin layer may be formed by adding a crosslinking agent or the like to a prepolymer of a binder raw material and curing or crosslinking the prepolymer. In the present invention, the above mixture will be referred to as the binder and described below.

[Conductive Fine Particle]

The electroconductive resin layer in the charging member contains a conductive fine particle to exhibit conductivity. Specific examples of the conductive fine particle include metal oxides, metal fine particles, and carbon black. These conductive fine particles can be used alone or in combination of two or more. The content of the conductive fine particle in the electroconductive resin layer is 2 to 200 parts by mass, and particularly 5 to 100 parts by mass based on 100 parts by mass of the binder as a guideline. The binder and conductive fine particle used in the first electroconductive resin layer and those used for the second electroconductive resin layer may be the same or different.

[Method of Forming Electroconductive Resin Layer]

A method of forming the electroconductive resin layer will be described below.

<Method 1> the Case where the Electroconductive Resin Layer is a Single Layer (the Case in FIG. 1A)

First, a coating layer having a conductive fine particle and a hollow resin particle dispersed in a binder (hereinafter, also referred to as a "preparative coating layer") is formed on the electro-conductive substrate. Next, the surface of the preparative coating layer is polished to remove part of the hollow resin particle and form the hollow resin particle into a bowl shape. Thereby, the concavity derived from the opening of the bowl-shaped resin particle and the protrusion derived from the edge of the opening of the bowl-shaped resin particle are formed in the surface of the preparative coating layer (hereinafter, also referred to as a "concavity and protrusion shape derived from the opening of the bowl-shaped resin particle").

[1-1. Dispersion of Resin Particle in Preparative Coating Layer]

First, a method of dispersing the hollow resin particle in the preparative coating layer will be described. Examples of the method include a method in which a hollow particle containing a gas inside thereof is dispersed with a binder and a conductive fine particle to prepare a coating of a conductive resin composition; the coating is applied onto an electro-conductive substrate; then, the coating is dried, cured, crosslinked or the like. Examples of the material used for the hollow resin particle can include resins as the binder or known resins.

Another examples of the method can include a method using the so-called heat expansive microcapsule, in which a resin particle contains an encapsulated substance inside thereof. When heat is applied to the resin particle, the encapsulated substance expands to make the resin particle hollow. In this method, the heat expansive microcapsule is dispersed with a binder and a conductive fine particle to prepare a conductive resin composition, the composition is applied onto an electro-conductive substrate to form a layer, and the layer is dried, cured, crosslinked or the like. In this method, the encapsulated substance can be expanded by heat generated during drying, curing, or crosslinking the binder used in the preparative coating layer to produce a hollow resin particle. At this time, the particle diameter can also be controlled by controlling the temperature condition.

When the heat expansive microcapsule is used, a thermoplastic resin needs to be used as the binder. Examples of the thermoplastic resin include: acrylonitrile resins, vinyl chloride resins, vinylidene chloride resins, methacrylic acid resins, styrene resins, urethane resins, amide resins, methacrylonitrile resins, acrylic acid resins, acrylic acid ester resins, and methacrylic acid ester resins. Among these, a thermoplastic resin including at least one selected from acrylonitrile resins, vinylidene chloride resins, and methacrylonitrile resins having low gas permeability and high impact resilience can be used. These resins are preferable because these resins are easily produced into the resin particle used in the present invention and easily dispersed in the binder resin. These thermoplastic resins can be used alone or in combination of two or more. Furthermore, the monomers that are raw materials for these thermoplastic resins may be copolymerized, and these thermoplastic resins may be used as a copolymer.

The substance encapsulated in the heat expansive microcapsule can be substances that vaporize at a temperature of the softening point or less of the thermoplastic resin to be used as the binder, and examples thereof include: low boiling point liquids such as propane, propylene, butene, normal butane, isobutane, normal pentane, and isopentane; and high boiling point liquids such as normal hexane, isohexane, normal heptane, normal octane, isooctane, normal decane, and isodecane.

The above heat expansive microcapsule can be produced by a known production method such as a suspension polymerization method, an interface polymerization method, an interface precipitation method, and a liquid drying method. Examples of the suspension polymerization method include a method in which a polymerizable monomer, the above substance encapsulated in the heat expansive microcapsule, and a polymerization initiator are mixed; after the mixture is dispersed in an aqueous medium containing a surfactant and a disperse stabilizer, the mixture is suspension polymerized. A compound having a reactive group reactive with a functional group in a polymerizable monomer, and an organic filler can be added.

Examples of the polymerizable monomer can include: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate, acrylic acid esters (such as methyl acrylate, ethyl acrylate, n-butyl acrylate, isobutyl acrylate, t-butyl acrylate, isobornyl acrylate, cyclohexyl acrylate, and benzyl acrylate), methacrylic acid esters (such as methyl methacrylate, ethyl methacrylate, n-butyl methacrylate, isobutyl methacrylate, t-butyl methacrylate, isobornyl methacrylate, cyclohexyl methacrylate, and benzyl methacrylate), styrene monomers, acrylamides, substituted acrylamides, methacrylamides, substituted methacrylamides, butadiene, ε-caprolactam, polyethers, and isocyanates. These polymerizable monomers can be used alone or in combination of two or more.

For the polymerization initiator, known peroxide initiators and azo initiators can be used. Among these, azo initiators are preferable from the viewpoint of control of polymerization, miscibility with the solvent, and safety during handling. Specific examples of the azo initiators include: 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile. Particularly, 2,2'-azobisisobutyronitrile is preferable from the viewpoint of the efficiency of the initiator. When the polymerization initiator is used, its amount can be 0.01 to 5 parts by mass based on 100 parts by mass of the polymerizable monomer. At an amount within this range, the effect of the polymerization initiator can be exhibited to attain a polymer having a sufficient polymerization degree.

For the surfactant, anionic surfactants, cationic surfactants, nonionic surfactants, amphoteric surfactants, high molecular dispersants, and the like can be used. When the surfactant is used, its amount can be 0.01 to 10 parts by mass based on 100 parts by mass of the polymerizable monomer. Examples of the disperse stabilizer include: organic fine particles (such as polystyrene fine particles, polymethyl methacrylate fine particles, polyacrylic acid fine particles, and polyepoxide fine particles), silica (such as colloidal silica), calcium carbonate, calcium phosphate, aluminum hydroxide, barium carbonate, and magnesium hydroxide. When the disperse stabilizer is used, the amount can be 0.01 to 20 parts by mass based on 100 parts by mass of the polymerizable monomer. At an amount within this range, dispersion can be stabilized, and an adverse effect of increasing the viscosity of the solvent caused by increase in the non-adsorbed dispersant can be prevented.

The suspension polymerization can be performed under a sealed condition using a pressure-resistant container in order to prevent the monomer and the solvent from evaporating or volatizing due to vaporization. Alternatively, after the reaction solution may be suspended with a dispersing machine, the suspension may be placed in a pressure-resistant container and suspension polymerized; or the reaction solution may be suspended in a pressure-resistant container and polymerized. The polymerization temperature can be 50° C. to 120° C. At a polymerization temperature within this range, a target polymer having a sufficient polymerization degree can be attained. The polymerization may be performed under atmospheric pressure. To prevent the substance encapsulated in the above heat expansive microcapsule from vaporizing, the polymerization can be performed under increased pressure (under a pressure atmospheric pressure plus 0.1 to 1 MPa). After the polymerization is completed, solid liquid separation and washing may be performed by centrifugation or filtering. When solid liquid separation and washing are performed, after these steps, the obtained product may be dried or crushed at a softening temperature or less of the resin that forms the heat expansive microcapsule. Drying and crushing can be performed by known methods, and an air dryer, a fair wind dryer, and a Nauta Mixer can be used. Drying and crushing can be performed at the same time with a crusher dryer. The surfactant and the disperse stabilizer can be removed by repeating washing and filtering after production.

[1-2. Method of Forming Preparative Coating Layer]

The method of forming the preparative coating layer will be described below.

Examples of the method of forming the preparative coating layer include electrostatic spray coating, dipping coating, roll coating, a method in which a sheet-like or tubular layer formed in a predetermined layer thickness is bonded to or covered on the electro-conductive substrate, and a method in which the material is cured and molded into a predetermined shape within a mold. Particularly when the binder is rubber, the electro-conductive substrate and an unvulcanized rubber composition can be integrally extruded using an extruder including a crosshead to produce the preparative coating layer. The crosshead is an extrusion metal mold used for producing a coating layer for electric wires and wires. In use, the crosshead is mounted on the tip of the cylinder in the extruder. Then, after drying, curing, or crosslinking, the surface of the preparative coating layer is polished to remove part of the hollow resin particle and form the hollow resin particle into a bowl shape. For the polishing method, a cylinder polishing method and a tape polishing method can be used. Examples of a cylinder polisher can include traverse mode NC cylinder polishers and plunge cutting mode NC cylinder polishers.

The hollow resin particle contains a gas inside thereof, and therefore has high impact resilience. Accordingly, for the binder in the preparative coating layer, a rubber or resin having relatively low impact resilience and a small elongation can be selected. Such a binder can attain a state where the preparative coating layer is easy to polish while the hollow resin particle is difficult to polish. When the preparative coating layer in this state is polished, only part of the hollow resin particle can be removed to produce a bowl-shaped resin particle. As a result, the opening of the bowl-shaped resin particle can be formed on the surface of the preparative coating layer. The method is a method for forming the concavity derived from the opening and the protrusion derived from the edge of the opening utilizing the difference in polishing properties of the hollow resin particle and the preparative coating layer. Accordingly, rubber can be used as the binder used in the preparative coating layer. Specifically, acrylonitrile butadiene rubber, styrene butadiene rubber or butadiene rubber having low impact resilience and a small elongation can be suitably used.

The hollow resin particle can be those containing a resin having a polar group from the viewpoint of a shell having low gas permeability and high impact resilience. Examples of such a resin include resins having the unit represented by the following formula (1). Furthermore, from the viewpoint of easy control of polishing, the resin more preferably has both the unit represented by the formula (1) and the unit represented by the formula (5).

Formula (1)

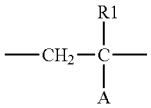

In the formula (1), A is at least one selected from units represented by the following formulas (2), (3), and (4); R1 represents a hydrogen atom or an alkyl group having 1 to 4 carbon atoms.

Formula (2)

Formula (3)

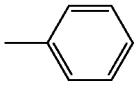

Formula (4)

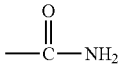

Formula (5)

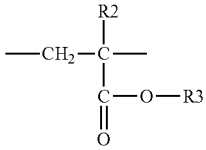

In the formula (5), R2 represents a hydrogen atom or an alkyl group having 1 to 4 carbon atoms; R3 represents a hydrogen atom or an alkyl group having 1 to 10 carbon atoms; R2 and R3 may have the same structure or different structures.

[1-3. Polishing Method]

For the polishing method, the cylinder polishing method and the tape polishing method can be used. A condition allowing faster polishing is preferable because the difference in polishing properties of the materials needs to be significantly exhibited. From this viewpoint, use of the cylinder polishing method is more preferable. Among these cylinder polishing methods, use of the plunge cutting mode is more preferable because the workspace can be simultaneously polished in the longitudinal direction and the polishing time can be shortened. In the related art, a spark-out step (a polishing step at a penetration rate of 0 mm/min) is performed for a uniform polished surface. However, preferably, the time for spark-out is reduced as much as possible or no spark-out is performed.

As an example, in the polishing condition for the preparative coating layer in use of the plunge cutting mode cylinder polisher, preferable ranges are shown below. The number of rotation of the cylinder polishing grinding wheel is 1000 rpm or more and 4000 rpm or less, and particularly preferably 2000 rpm or more and 4000 rpm. The penetration rate for the preparative coating layer is 5 mm/min or more and 30 mm/min or less, and particularly preferably 10 mm/min or more. At the end of the penetration step, the polished surface may be subjected to a break-in step. The break-in step can be performed within 2 seconds at a penetration rate of 0.1 mm/min to 0.2 mm/min. The time for the spark-out step (a polishing step at a penetration rate of 0 mm/min) can be 3 seconds or less. When the member having the preparative coating layer formed thereon has a shape allowing rotation (such as a roller shape), the number of rotation is 50 rpm or more and 500 rpm or less, and particularly preferably 200 rpm or more and 500 rpm or less. If the penetration rate for the preparative coating layer and the spark-out step are set according to the above conditions, the concavity and protrusion shape derived from the opening of the bowl-shaped resin particle can be formed on the surface of the electroconductive resin layer more easily.

The roller in which the preparative coating layer is polished can be used as the charging member according to the present invention as it is. Moreover, the layer in which the preparative coating layer is polished can be used as the first electroconductive resin layer, and the second electroconductive resin layer can be formed on the surface thereof. The thus-configured roller can be used as the charging member according to the present invention.

<Method 2> the Case where the Electroconductive Resin Layer is Composed of Two Layers (the Case in FIG. 1B)

[2-1. Formation of Second Electroconductive Resin Layer]

The surface of the first electroconductive resin layer obtained by the above method is coated with the conductive resin composition, and the coating is dried, cured, or crosslinked. Thereby, the second electroconductive resin layer can be formed. For the coating method, the above methods can be used. The concavity derived from the opening of the bowl-shaped resin particle and the protrusion derived from the edge thereof that exist on the surface of the first electroconductive resin layer need to be reflected on the surface of the second electroconductive resin layer. For this reason, the second electroconductive resin layer can be relatively thin. The thickness of the second electroconductive resin layer is 50 μm or less, and particularly 30 μm or less as the guideline. Accordingly, among the above coating methods, the method of forming the second electroconductive resin layer by electrostatic spray coating, dipping coating, or roll coating is more preferable. When these coating methods are used, a coating solution of a conductive resin composition prepared by dispersing the conductive fine particle in the binder is prepared, and used for coating.

[2-2. Irradiation with Electron Beam]

Furthermore, after the layer in which the preparative coating layer is polished or the second electroconductive resin layer is formed, the surface thereof may be irradiated with ultraviolet light or an electron beam.

Figure 9:
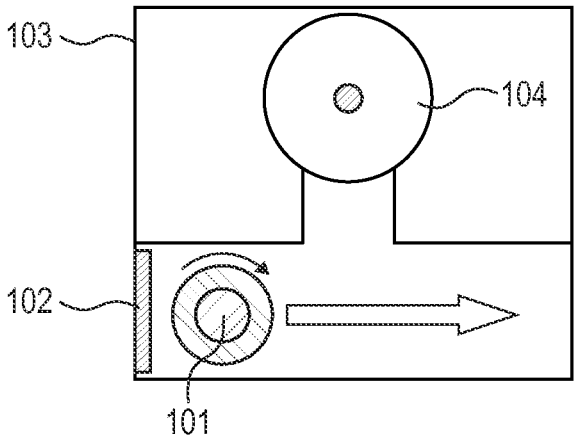
FIG. 9 is a schematic view illustrating one example of an electron beam irradiating apparatus used in the present invention.

FIG. 9 is a schematic view illustrating an example of a method in which a roller-like member having the electroconductive resin layer formed thereon is irradiated with an electron beam. First, a member 101 having the electroconductive resin layer formed thereon is mounted on a rotary jig not illustrated, and transported into an electron beam irradiating apparatus 103 from an entrance with a shutter 102. Subsequently, the shutter is closed, the inner atmosphere of the electron beam irradiating apparatus is replaced with nitrogen. After it is checked that the concentration of oxygen is reduced to 100 ppm or less, the member is irradiated with an electron beam emitted from an electron beam generating unit 104. The electron beam generating unit 104 includes a vacuum chamber for accelerating an electron beam and a filament-like cathode. When the cathode is heated, thermoelectrons are emitted from the surface of the cathode. The thermoelectrons thus emitted are accelerated by the accelerating voltage, and then emitted as an electron beam. The number of electron beams emitted from the cathode (exposure dose) can be controlled by changing the shape of the filament and the heating temperature of the filament.

The exposure dose of the electron beam in irradiation with the electron beam is defined by the following equation (1):

$$D=(K\cdot I)/V \quad (1)$$

wherein D is an exposure dose (kGy), K is an apparatus constant, I is an electron current (mA), and V is a process speed (m/min). The apparatus constant K is a constant that designates the efficiency of an apparatus, and is an index designating the performance of the apparatus. The apparatus constant K can be determined by measuring the exposure dose while the electron current and the process speed vary under the condition of a constant accelerating voltage. The exposure dose of the electron beam is measured as follows: a film for measuring an exposure dose is bonded to the surface of the roller, the roller is treated actually with the electron beam irradiating apparatus, and the exposure dose of the electron beam in the film for measuring an exposure dose is measured with a film dosimeter. The film for measuring an exposure dose is FWT-60, and the film dosimeter is an FWT-92D type (both are made by Far West Technology, Inc.). The exposure dose of the electron beam in the present invention can be in the range of 30 kGy or more from the viewpoint of the effect of surface modification and in the range of 3000 kGy or less from the viewpoint of prevention of excessive crosslinking of the surface and decay.

[Other Components in Electroconductive Resin Layer]

The electroconductive resin layer in the charging member may contain a known ionic conductive agent and an insulation particle in addition to the conductive fine particle.

[Volume Resistivity of Electroconductive Resin Layer]

The volume resistivity of the electroconductive resin layer can be $1\times10^{2}$ Ω·cm or more and $1\times10^{16}$ Ω·cm or less under an environment of a temperature of 23° C. and a relative humidity of 50% as a guideline. At a volume resistivity within this range, it is easier to suitably charge the electrophotographic photosensitive member by discharge.

The volume resistivity of the electroconductive resin layer is determined as follows. First, the electroconductive resin layer is cut out from the charging member to produce a strip having a length of 5 mm, a width of 5 mm, and a thickness of 1 mm or the like. A metal is deposited on both surfaces of the strip to produce an electrode and a guard electrode. Thus, a sample for measurement is obtained. When the electroconductive resin layer cannot be cut out in a form of a thin film, a conductive resin composition for forming an electroconductive resin layer is applied onto an aluminum sheet to form a coating, and a metal is deposited on the coating surface to obtain a sample for measurement. A voltage of 200 V is applied to the obtained sample for measurement using a microammeter (trade name: ADVANTEST R8340A ULTRAHIGHRESISTANCE METER, made by Advantest Corporation). Then, the current after 30 seconds is measured. The volume resistivity is determined by calculation from the thickness of the film and the area of the electrode. The volume resistivity of the electroconductive resin layer can be controlled by the above conductive fine particle and ionic conductive agent. The average particle diameter of the conductive fine particle is 0.01 μm to 0.9 μm, and particularly 0.01 μm to 0.5 μm as a guideline. The content of the conductive fine particle in the electroconductive resin layer is 2 to 80 parts by mass, and particularly 20 to 60 parts by mass based on 100 parts by mass of the binder as a guideline.

[Electro-Conductive Substrate]

The electro-conductive substrate used in the charging member according to the present invention has conductivity, and has a function to support the electroconductive resin layer or the like disposed thereon. Examples of materials for the support can include metals such as iron, copper, stainless steel, aluminum, and nickel and alloys thereof.

<Process Cartridge>

Figure 10:
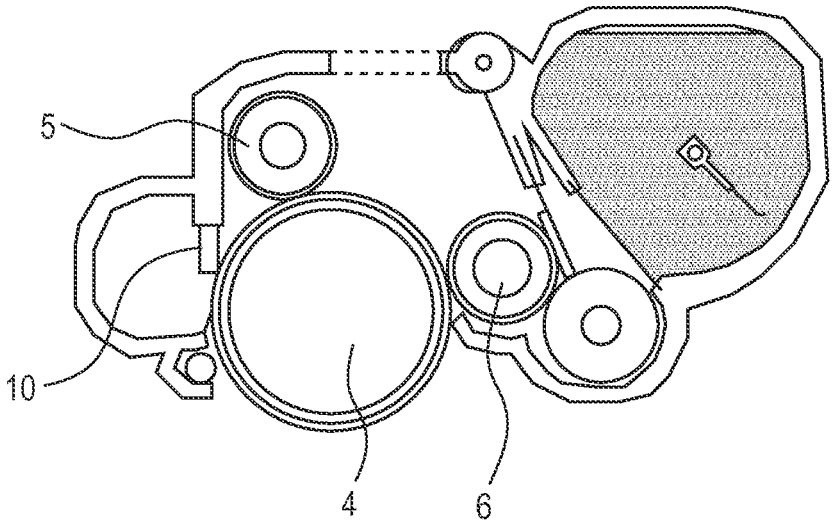
FIG. 10 is a schematic sectional view illustrating one aspect of a process cartridge according to the present invention.

An example of the process cartridge according to the present invention is illustrated in FIG. 10. The process cartridge includes the charging member and the electrophotographic photosensitive member, and can be detachably attached to the main body of the electrophotographic apparatus.

<Electrophotographic Apparatus>

The electrophotographic apparatus according to the present invention is an electrophotographic apparatus on which the electrophotographic process cartridge according to the present invention is mounted. The electrophotographic apparatus illustrated in FIG. 6 includes an electrophotographic process cartridge into which an electrophotographic photosensitive member, a charging apparatus, a developing apparatus, a cleaning apparatus, and the like are integrated; a latent image forming apparatus; a developing apparatus; a transfer apparatus; and a fixing apparatus.

An electrophotographic photosensitive member 4 is a rotary drum type member having a photosensitive layer on an electro-conductive substrate. The electrophotographic photosensitive member 4 is rotatably driven in the arrow direction at a predetermined circumferential speed (process speed). The charging apparatus includes a contact type charging roller 5 which is brought into contact with the electrophotographic photosensitive member 4 at a predetermined pressure to be contact disposed. The charging roller 5 rotates following the rotation of the electrophotographic photosensitive member. When the charging roller 5 applies a predetermined DC voltage from a power supply for charging 19, the electrophotographic photosensitive member is charged to a predetermined potential. For a latent image forming apparatus 11 for forming an electrostatic latent image on the electrophotographic photosensitive member 4, an exposure apparatus such as a laser beam scanner is used. An electrostatic latent image is formed by exposing a uniformly charged electrophotographic photosensitive member in correspondence with image information. The developing apparatus includes a developing sleeve or developing roller disposed close to or in contact with the electrophotographic photosensitive member 4. Using an electrostatically treated toner to have the same polarity as the charging polarity of the electrophotographic photosensitive member, an electrostatic latent image is developed by reversal development to form a toner image. The transfer apparatus includes a contact type transfer roller 8. The toner image is transferred from the electrophotographic photosensitive member onto a transfer material 7 such as normal paper. The transfer material 7 is conveyed by a sheet feeding system having a conveying member. The cleaning apparatus includes a blade type cleaning member 10 and a recovering container 14. After transfer, the cleaning apparatus dynamically scrapes off the transfer remaining toner left on the electrophotographic photosensitive member and recovers the toner. Here, the cleaning apparatus can be eliminated by adopting a simultaneous developing and cleaning method in which the transfer remaining toner is recovered with the developing apparatus. The fixing apparatus 9 is composed of a heated roller or the like. The fixing apparatus 9 fixes the transferred toner image on the transfer material 7, and discharges the transfer material 7 to the outside of the apparatus.

EXAMPLES

Hereinafter, the present invention will be described more in details according to Examples. Prior to Examples, Production Examples A1 to A19 of the electrophotographic photosensitive member, methods of evaluating a charging member and a resin particle, Production Examples b1 to b11 of the resin particle, Production Examples c1 to c18 of the conductive rubber composition, Production Example of a conductive particle d1, Production Example of an insulation particle d2, and Production Examples T1 to T23 of the charging member will be described.

Production Examples A1 to A19 of Electrophotographic Photosensitive Member

Production Example A1

An aluminum cylinder having a diameter of 24 mm and a length of 261.6 mm was used as the support. Next, using a mixed solvent of 10 parts by mass of $SnO_2$ coated barium sulfate (conductive particle), 2 parts of titanium oxide (pigment for adjusting resistance), 6 parts by mass of a phenol resin (binder resin), 0.001 parts by mass of silicone oil (leveling agent), 4 parts by mass of methanol, and 16 parts by mass of methoxypropanol, a coating solution for an electrically conductive layer was prepared. The coating solution for an electrically conductive layer was applied onto the support by immersion coating, and cured (thermally cured) for 30 minutes at 140° C. to form an electrically conductive layer having a layer thickness of 15 μm on the support.

Next, 3 parts by mass of N-methoxymethylated nylon and 3 parts by mass of copolymerized nylon were dissolved in a mixed solvent of 65 parts by mass of methanol and 30 parts by mass of n-butanol to prepare a coating solution for an intermediate layer. The coating solution for an intermediate layer was applied onto the electrically conductive layer by immersion coating, and dried for 10 minutes at 80° C. to form an intermediate layer having a layer thickness of 0.7 μm on the electrically conductive layer.

Next, as the charge generating substance, 10 parts by mass of hydroxygallium phthalocyanine crystal having strong peaks at 7.5°, 9.9°, 16.3°, 18.6°, 25.1°, and 28.3° at the Bragg angle 2θ±0.2° in CuKα properties X ray diffraction was used. The hydroxygallium phthalocyanine crystal was added to a solution prepared by dissolving 5 parts by mass of a polyvinyl butyral resin (trade name: S-LEC BX-1, made by Sekisui Chemical Co., Ltd.) in 250 parts by mass of cyclohexanone. The obtained solution was dispersed under a 23±3° C. atmosphere for one hour with a sand mill apparatus using glass beads having a diameter of 1 mm, and 250 parts by mass of ethyl acetate was added to prepare a coating solution for a charge-generating layer. The coating solution for a charge-generating layer was applied onto the intermediate layer by immersion coating, and dried for 10 minutes at 100° C. to form a charge-generating layer having a layer thickness of 0.26 μm.

Next, 5.6 parts by mass of the compound represented by the following formula (CTM-1) (charge transport substance), 2.4 parts by mass of the compound represented by the following formula (CTM-2) (charge transport substance), 10 parts by mass of a polycarbonate resin A(1) (resin A(1)), and 0.36 parts by mass of a polycarbonate resin D(1) (resin D(1)) were dissolved in 2.5 parts by mass of methyl benzoate, 20 parts by mass of dimethoxymethane, and 30 parts by mass of o-xylene to prepare a coating solution for a charge-transport layer.

(CTM-1)

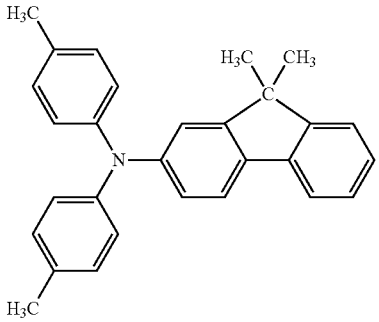

(CTM-2)

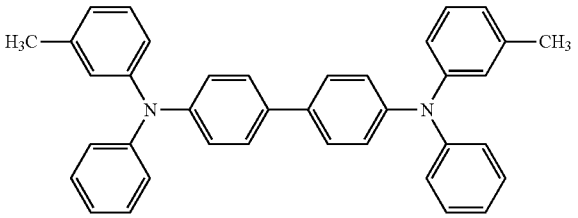

The coating solution for a charge-transport layer was applied onto the charge-generating layer by immersion coating, and dried at 125° C. for 30 minutes to form a charge-transport layer having a layer thickness of 15 μm on the charge-generating layer. It was found by gas chromatography that the formed charge-transport layer contained 0.028% by mass of methyl benzoate. Thus, an electrophotographic photosensitive member A1 was produced in which the charge-transport layer was the surface layer.

Production Examples A2 to A18

Electrophotographic photosensitive members A2 to A18 were produced in the same manner as in Production Example 1 except that the resin (α), the resin (β), and the compound (γ) in Production Example 1 were changed as shown in Table 4. The amount (% by mass) of the compound (γ) contained in the charge-transport layer as the surface layer was found in the same manner as in Example 1. The results are shown in Table 4.

Production Example A19

Electrophotographic photosensitive member A19 was produced in the same manner as in Production Example 1 except that the compound (γ) in Production Example 1 was not used.

TABLE 4

| Electro-photographic photo-sensitive member | Resin (α) Kind | Resin (α) Parts by mass | Resin (β) Kind | Resin (β) Parts by mass | Amount (% by mass) of (β) based on (α) | Compound (γ) Kind | Compound (γ) Parts by mass | Amount (% by mass) of (γ) in surface layer |
|---|---|---|---|---|---|---|---|---|
| A1 | Resin A (1) | 10 | Resin D (1) | 0.36 | 3.6 | Methyl benzoate | 2.5 | 0.028 |
| A2 | Resin A (1) | 10 | Resin D (1) | 0.36 | 3.6 | Methyl benzoate | 0.5 | 0.012 |
| A3 | Resin A (1) | 10 | Resin D (1) | 0.36 | 3.6 | Methyl benzoate | 8 | 0.120 |
| A4 | Resin A (1) | 10 | Resin D (1) | 0.01 | 0.1 | Methyl benzoate | 2.5 | 0.030 |
| A5 | Resin A (1) | 10 | Resin D (1) | 5 | 50 | Methyl benzoate | 2.5 | 0.031 |
| A6 | Resin A (1) | 10 | Resin D (1) | 0.36 | 3.6 | Ethyl benzoate | 2.5 | 0.029 |
| A7 | Resin A (1) | 10 | Resin D (1) | 0.36 | 3.6 | Benzyl acetate | 2.5 | 0.033 |
| A8 | Resin A (1) | 10 | Resin D (1) | 0.36 | 3.6 | Ethyl 3-ethoxypropionate | 2.5 | 0.035 |
| A9 | Resin A (1) | 10 | Resin D (1) | 0.36 | 3.6 | Diethylene glycol ethyl methyl ether | 2.5 | 0.028 |
| A10 | Resin A (1) | 10 | Resin D (1) | 0.36 | 3.6 | Methyl benzoate | 2.5 | 0.028 |
| A11 | Resin A (1) | 10 | Resin D (1) | 0.36 | 3.6 | Methyl benzoate | 0.5 | 0.003 |
| A12 | Resin A (1) | 10 | Resin D (1) | 0.36 | 3.6 | Methyl benzoate | 8 | 0.050 |
| A13 | Resin A (1) | 10 | Resin E (1) | 0.36 | 3.6 | Methyl benzoate | 2.5 | 0.025 |
| A14 | Resin A (1) | 10 | Resin E (1) | 0.36 | 3.6 | Methyl benzoate | 0.5 | 0.012 |
| A15 | Resin A (1) | 10 | Resin E (1) | 0.36 | 3.6 | Methyl benzoate | 8 | 0.120 |
| A16 | Resin A (1) | 10 | Resin F (1) | 0.36 | 3.6 | Methyl benzoate | 2.5 | 0.028 |
| A17 | Resin A (1) | 10 | Resin F (1) | 0.36 | 3.6 | Methyl benzoate | 0.5 | 0.012 |

Production Examples b1 to b11 of Resin Particle

Production Example b1

4000 parts by mass of ion exchange water and 9 parts by mass of colloidal silica and 0.15 parts by mass of polyvinylpyrrolidone as the disperse stabilizer were added to prepare an aqueous mixed solution. Next, 50 parts by mass of acrylonitrile, 45 parts by mass of methacrylonitrile, and 5 parts by mass of methyl methacrylate as polymerizable monomers, 12.5 parts by mass of normal hexane as the encapsulated substance, and 0.75 parts by mass of dicumyl peroxide as the polymerization initiator were used to prepare an oily mixed solution. The oily mixed solution was added to the aqueous mixed solution, and further 0.4 parts by mass of sodium hydroxide was added to prepare a dispersion liquid. The obtained dispersion liquid was stirred and mixed using a homogenizer for 3 minutes, and charged into a polymerization reaction container whose inside was replaced by nitrogen. Under stirring at 200 rpm, the dispersion liquid was reacted at 60° C. for 20 hours to prepare a reaction product. The obtained reaction product was repeatedly filtered and washed with water, and then dried at 80° C. for 5 hours to produce a resin particle. The obtained resin particle was crushed and classified with a sonic classifier to obtain a resin particle b1 having an average particle diameter of 12 μm.

Production Example b2

A resin particle was produced by the same method as that in Production Example b1 except that the amount of the colloidal silica to be added in Production Example b1 was changed to 4.5 parts by mass. The obtained reaction product was classified in the same manner to obtain a resin particle b2 having an average particle diameter of 50 μm.

Production Examples b3 to b7

The particles classified in Production Example b2 and having different average particle diameters shown in Table 5 below were used as resin particles b3 to b7.

TABLE 5

| Resin particle No. | Average particle diameter (μm) |
|---|---|
| b3 | 60 |
| b4 | 18 |
| b5 | 10 |
| b6 | 40 |
| b7 | 15 |

Production Example b8

A resin particle was produced by the same method as that in Production Example b1 except that the polymerizable monomers in Production Example b1 were replaced by 45 parts by mass of methacrylonitrile and 55 parts by mass of methyl acrylate, and classified to obtain a resin particle b8 having an average particle diameter of 25 μm.

Production Example b9

A resin particle was produced by the same method as that in Production Example b2 except that the polymerizable monomers in Production Example b2 were replaced by 45 parts by mass of acrylamide and 55 parts by mass of methacrylamide, and classified to obtain a resin particle b9 having an average particle diameter of 45 μm.

Production Example b10

A resin particle was produced by the same method as that in Production Example b2 except that the polymerizable monomers in Production Example b2 were replaced by 60 parts by mass of methyl methacrylate and 40 parts by mass of acrylamide, classified to obtain a resin particle b10 having an average particle diameter of 10 μm.

Production Example b11

A resin particle was produced by the same method as that in Production Example b1 except that the polymerizable monomer in Production Example b1 was replaced by 100 parts by mass of acrylamide. The resin particle was classified in the same manner to obtain a resin particle b11 having an average particle diameter of 8 μm.

Production Examples c1 to c18 of Conductive Rubber Composition

Production Example c1

The four other materials shown in Component (1) in Table 6 below were added based on 100 parts by mass of an acrylonitrile butadiene rubber (NBR) (trade name: N230SV, made by JSR Corporation), and kneaded for 15 minutes with a sealed type mixer whose temperature was adjusted at 50° C. The three materials shown in Component (2) in Table 6 were added to the kneaded product. Next, these were kneaded for minutes with a two-roll mill whose temperature was cooled to 25° C. Thus, a conductive rubber composition c1 was produced.

TABLE 6

| | | Parts by mass |
|---|---|---|
| Component (1) | Acrylonitrile butadiene rubber (NBR) (trade name: N230SV, made by JSR Corporation) | 100 |
| | Carbon black (trade name: TOKABLACK #7360SB, made by Tokai Carbon Co., Ltd.) | 48 |
| | Zinc stearate (trade name: SZ-2000, made by Sakai Chemical Industry Co., Ltd.) | 1 |
| | Zinc oxide (trade name: two zinc oxides, made by Sakai Chemical Industry Co., Ltd.) | 5 |
| | Calcium carbonate (trade name: Silver-W, made by Shiraishi Kogyo Kaisha, Ltd.) | 20 |
| Component (2) | Resin particle b1 | 12 |
| | Sulfur (vulcanizing agent) | 1.2 |
| | Tetrabenzylthiuram disulfide (TBzTD) (trade name: Perkacit TBzTD, made by Flexsys America LP, vulcanization accelerator) | 4.5 |

Production Example c2

A conductive rubber composition c2 was produced in the same manner as in Production Example c1 except that the resin particle b1 was replaced by the resin particle b2.

Production Examples c3 to c8

Conductive rubber compositions c3 to c8 were produced in the same manner as in Production Example c1 except that the kind and amount of the resin particle added were changed as shown in Table 9.

Production Example c9

The six other materials shown in Component (1) in Table 7 below were added based on 100 parts by mass of a styrene butadiene rubber (SBR) (trade name: SBR1500, made by JSR Corporation), and kneaded for 15 minutes with a sealed type mixer whose temperature was adjusted at 80° C. The three materials shown in Component (2) in Table 7 were added to the kneaded product. Next, these were kneaded for 10 minutes with a two-roll mill whose temperature was cooled to 25° C. Thus, a conductive rubber composition c9 was produced.

TABLE 7

| | Material | Parts by mass |
|---|---|---|
| Component (1) | Styrene butadiene rubber (SBR) (trade name: SBR1500, made by JSR Corporation) | 100 |
| | Zinc oxide (trade name: two zinc oxides, made by Sakai Chemical Industry Co., Ltd.) | 5 |
| | Zinc stearate (trade name: SZ-2000, made by Sakai Chemical Industry Co., Ltd.) | 2 |
| | Carbon black (trade name: ketjen black EC600JD, made by Lion Corporation) | 8 |
| | Carbon black (trade name: SEAST S, made by Tokai Carbon Co., Ltd.) | 40 |
| | Calcium carbonate (trade name: Silver-W, made by Shiraishi Kogyo Kaisha, Ltd.) | 15 |
| | Paraffin oil (trade name: PW380, made by Idemitsu Kosan Co., Ltd.) | 20 |
| Component (2) | Resin particle b6 | 20 |
| | Sulfur (vulcanizing agent) | 1 |
| | Dibenzothiazylsulfide (DM) (trade name: NOCCELER DM, made by Ouchi Shinko Chemical Industrial Co., Ltd., vulcanization accelerator) | 1 |

Production Examples c10 to c15

Conductive rubber compositions c10 to c15 were produced in the same manner as in Production Example c1 except that the kind and amount of the resin particle added were changed as shown in Table 9.

Production Example c16

The acrylonitrile butadiene rubber in Production Example c1 was replaced by butadiene rubber (BR) "JSR BR01" (trade name, made by JSR Corporation), the amount of carbon black was 30 parts by mass, and the resin particle b1 was replaced by the resin particle **10*b*** (5 parts by mass). Except these, a conductive rubber composition c16 was produced in the same manner as in Production Example c1.

Production Example c17

A conductive rubber composition c17 was produced in the same manner as in Production Example c1 except that the kind and amount of the resin particle added were changed as shown in Table 9.

Production Example c18

The three other materials shown in Component (1) in Table 8 below were added based on 75 parts by mass of a chloroprene rubber (trade name: Shoprene WRT, made by Showa Denko K.K.), and kneaded for 15 minutes with a sealed type mixer whose temperature was adjusted at 50° C. The three materials shown in Component (2) in Table 8 were added to the kneaded product, and kneaded for 15 minutes with a two-roll mill whose temperature was cooled to 20° C. Thus, a conductive rubber composition c18 was produced.

TABLE 8

| | Material | Parts by mass |
|---|---|---|
| Component (1) | Chloroprene rubber (trade name: Shoprene WRT, made by Showa Denko K.K.) | 75 |
| | NBR (trade name: Nipol 401LL, made by ZEON Corporation) | 25 |
| | Hydrotalcite (trade name: DHT-4A-2, made by Kyowa Chemical Industry Co., Ltd.) | 3 |
| | Quaternary ammonium salt (trade name: KS-555, made by Kao Corporation) | 5 |
| Component (2) | Resin particle b11 | 3 |
| | Sulfur (vulcanizing agent) | 0.5 |
| | Ethylene thiourea (trade name: ACCEL 22-S, made by Kawaguchi Chemical Industry Co., LTD., vulcanization accelerator) | 1.4 |

TABLE 9

| | | Resin particle | | | |
|---|---|---|---|---|---|
| Conductive rubber composition | Binder Rubber | Resin particle | Material | Particle diameter (μm) | Parts by mass |
| c1 | NBR | b1 | Acrylonitrile-methacrylonitrile-methyl methacrylate | 12 | 12 |
| c2 | NBR | b2 | Acrylonitrile-methacrylonitrile-methyl methacrylate | 50 | 12 |
| c3 | NBR | b1 | Acrylonitrile-methacrylonitrile-methyl methacrylate | 12 | 10 |
| c4 | NBR | b3 | Acrylonitrile-methacrylonitrile-methyl methacrylate | 60 | 15 |
| c5 | NBR | b4 | Acrylonitrile-methacrylonitrile-methyl methacrylate | 18 | 8 |
| c6 | NBR | b5 | Acrylonitrile-methacrylonitrile-methyl methacrylate | 10 | 5 |
| c7 | NBR | b6 | Acrylonitrile-methacrylonitrile-methyl methacrylate | 40 | 10 |
| c8 | NBR | b7 | Acrylonitrile-methacrylonitrile-methyl methacrylate | 15 | 20 |

TABLE 9-continued

| Conductive rubber composition | Binder Rubber | Resin particle | Resin particle Material | Particle diameter (μm) | Parts by mass |
|---|---|---|---|---|---|
| c9 | SBR | b6 | Acrylonitrile-methacrylonitrile-methyl methacrylate | 40 | 20 |
| c10 | NBR | b8 | Methacrylonitrile-methyl acrylate | 25 | 8 |
| c11 | NBR | b8 | Methacrylonitrile-methyl acrylate | 25 | 12 |
| c12 | NBR | b8 | Methacrylonitrile-methyl acrylate | 25 | 15 |
| c13 | NBR | b8 | Methacrylonitrile-methyl acrylate | 25 | 18 |
| c14 | NBR | b8 | Methacrylonitrile-methyl acrylate | 25 | 20 |
| c15 | NBR | b9 | Acrylamide-methacrylamide | 45 | 12 |
| c16 | BR | b10 | Methyl methacrylate-acrylamide | 10 | 5 |
| c17 | NBR | b8 | Methacrylonitrile-methyl acrylate | 25 | 5 |
| c18 | CR/NBR | b11 | Acrylamide | 8 | 3 |

Production Examples of Conductive Particle and Insulation Particle

Production Example d1

140 parts by mass of methyl hydrogen polysiloxane was added to 7000 parts by mass of a silica particle (average particle size: 15 nm, volume resistivity: $1.8\times10^{12}$ Ω·cm) while an edge runner was operated, and mixed and stirred at a line load of 588 N/cm (60 kg/cm) for 30 minutes. At this time, the stirring rate was 22 rpm. 7000 parts by mass of a carbon black "#52" (trade name, made by Mitsubishi Chemical Corporation) was added to the mixture over 10 minutes while the edge runner was operated, and further mixed and stirred at a line load of 588 N/cm (60 kg/cm) for 60 minutes. Thus, the carbon black was attached to the surface of the silica particle coated with methyl hydrogen polysiloxane, and then dried at 80° C. for 60 minutes with a dryer to produce a composite conductive fine particle 1. At this time, the stirring rate was 22 rpm. The obtained composite conductive fine particle 1 had an average particle diameter of 15 nm and a volume resistivity of $1.1\times10^{2}$ Ω·cm.

Production Example d2

110 parts by mass of isobutyltrimethoxysilane as a surface treatment agent and 3000 parts by mass of toluene as a solvent were blended with 1000 parts by mass of a needle-like rutile titanium oxide particle (average particle diameter: 15 nm, length:width=3:1, volume resistivity: $2.3\times10^{10}$ Ω·cm) to prepare a slurry. After the slurry was mixed for 30 minutes with a stirrer, the slurry was fed to a Visco Mill having glass beads having an average particle size of 0.8 mm filled up to 80% of the effective inner volume. Then, the slurry was wet crushed at a temperature of 35±5° C. Using a kneader, toluene was removed from the slurry obtained by the wet crushing by reduced pressure distillation (bath temperature: 110° C., product temperature: to 60° C., reduced pressure degree: approximately 100 Torr). Then, a surface treatment agent was baked to the slurry at 120° C. for 2 hours. The baked particle was cooled to room temperature, and then ground using a pin mill to produce a surface treated titanium oxide particle 1 (insulation particle).

<Method of Evaluating Charging Member and Resin Particle>

[1. Electric Resistance Value of Charging Member]

Figure 5:
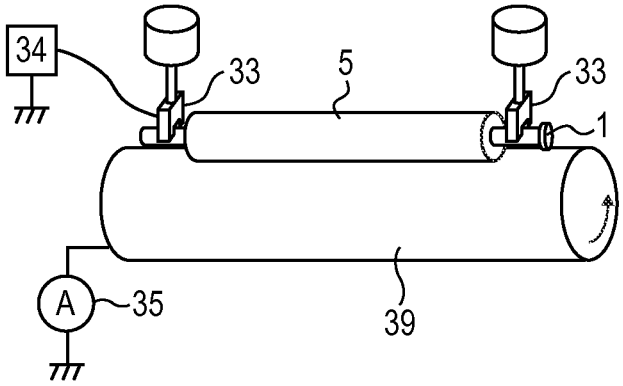
FIG. 5 is a diagram illustrating an apparatus for measuring an electric resistance value of a charging roller.

FIG. 5 illustrates a measurement apparatus for measuring the electric resistance value of the charging roller. A load is applied to each of the ends of the electro-conductive substrate 1 via bearings 33 to bring the charging roller 5 into contact with a cylindrical metal 39 having the same curvature as that of the electrophotographic photosensitive member parallel to the cylindrical metal 39. In this state, while the cylindrical metal 39 is rotated by a motor (not illustrated) to rotate the contacted charging roller 5 following the rotation of the cylindrical metal 39, a DC voltage of −200 V is applied from a stabilized power supply 34. The current that flows at this time is measured with an ammeter 35, and the electric resistance value of the charging roller is calculated. The load is 4.9 N. The metallic cylinder has a diameter of 30 mm, and is rotated at a circumferential speed of 45 mm/sec.

In the measurement, the charging roller is left as it is to stand for 24 hours or more in an environment of a temperature of 23° C. and a relative humidity of 50%, and measured using the measurement apparatus left under the same environment.

[2. Measurement of Surface Roughness Rzjis of Charging Member and Average Interval RSm Between Concavity and Protrusion]

Using a surface roughness measurement apparatus (trade name: SE-3500, made by Kosaka Laboratory Ltd.), the measurement is performed in accordance with Japanese Industrial Standards (JIS) B 0601-1994. Rzjis is an average value of measured values at six places selected at random in the charging member. Sm is determined as follows: ten intervals between the concavity and the protrusion are measured in each of six places selected at random in the charging member, and the average value of the ten intervals is determined for each of the six places; then, the average value of "the average values in the six places" is calculated. In the measurement, a cut-off value is 0.8 mm, and an evaluation length is 8 mm.

[3. Measurement of Shape of Bowl-Shaped Resin Particle]

Ten places in total are measured: two places in the roller circumferential direction (phase: 0° and 180°) in each of five places in the longitudinal direction, that is, the central portion in the roller longitudinal direction, places 45 mm spaced from the central portion in the directions of both ends, and places 90 mm spaced from the central portion in the directions of both ends. In these measurement places, the electroconductive resin layer is cut out by 20 nm over 500 μm using a focused ion beam machining observation apparatus (trade name: FB-2000C, made by Hitachi, Ltd.), and the images of the cross sections are photographed. The obtained images of the cross sections are combined, and a stereoscopic image of the bowl-shaped resin particle is calculated. From the stereoscopic image, the largest diameter 58 of the bowl-shaped resin particle illustrated in FIG. 3 and the smallest diameters 74 of the openings illustrated in FIGS. 4A to 4E are calculated. From the above stereoscopic image, the thickness of the shell of the bowl-shaped resin particle is measured at any five points of the bowl-shaped resin particle. Such measurement is performed on ten resin particles within the field, and the average value of the obtained 100 measured values in total is calculated. The values thus determined are defined as "the largest diameter of the bowl-shaped resin particle," "the smallest diameter of the opening," and "the thickness of the shell," respectively. In the measurement of the thickness of the shell, it was found in the respective bowl-shaped resin particles that the largest thickness of the shell was twice or less the smallest thickness thereof, namely, the shell had a substantially uniform thickness.

[4. Measurement of Height Difference Between Bottom of Concavity and Vertex of Protrusion in Surface of Charging Member]

The surface of the charging member is observed using a laser microscope (trade name: LXM5 PASCAL; made by Carl Zeiss AG) in a field having a length of 0.5 mm and a width of 0.5 mm. The X-Y plane within the field is scanned with laser to obtain two-dimensional image data. Further, the focus is moved in the Z direction, and the above scanning is repeated to obtain three-dimensional image data. As a result, first, it is observed whether the surface of the charging member has the concavity derived from the opening of the bowl-shaped resin particle and the protrusion derived from the edge of the opening of the bowl-shaped resin particle. Furthermore, the height difference 57 between the vertex 55 of the protrusion 54 and the bottom 56 of the concavity is calculated. Two bowl-shaped resin particles within the field are subjected to such a process. The same measurement is performed in 50 places in the longitudinal direction of the charging member, and the average value of the obtained 100 measured values in total is calculated. The average value is defined as the "height difference."

[5. Method of Measuring Average Particle Diameter of Resin Particle]

Using a Coulter Counter Multisizer, a resin particle powder is measured. Specifically, 0.1 to 5 ml of a surfactant (alkylbenzene sulfonic acid salt) is added to 100 to 150 ml of an electrolyte solution, and 2 to 20 mg of a resin particle is added to the solution. The electrolyte solution having the resin particle suspended therein is dispersed for 1 to 3 minutes with an ultrasonic disperser, and volume-based particle size distribution is measured using the Coulter Counter Multisizer with a 100 μm aperture. From the obtained particle size distribution, the volume average particle size is determined by computer processing. This is defined as the average particle diameter of the resin particle.

Production Examples of Charging Roller

Production Example T1

1. Production of Electro-Conductive Substrate

A thermosetting adhesive containing 10% by mass of carbon black was applied to a stainless steel rod having a diameter of 6 mm and a length of 252.5 mm, and dried. This rod was used as the electro-conductive substrate.

2. Production of Charging Roller

Figure 7:
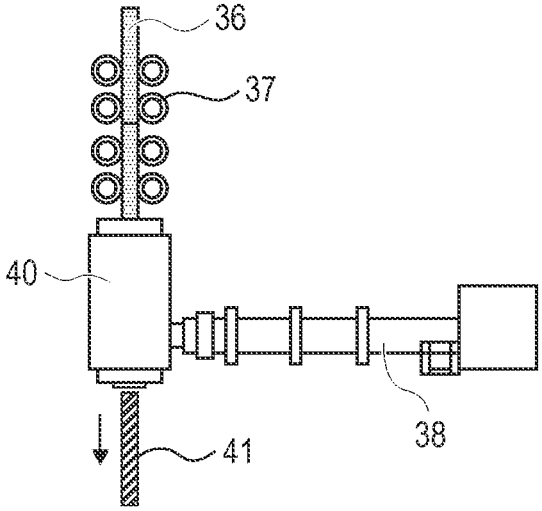
FIG. 7 is a sectional view of a crosshead extruder used in production of a charging roller.

Using the extrusion molding apparatus with a crosshead illustrated in FIG. 7, the electro-conductive substrate was used as the central shaft, and its outer periphery was coaxially coated with the conductive rubber composition c1 into a cylindrical shape. Thus, a rubber roller was produced. The thickness of the coated rubber composition was adjusted to be 1 mm. In FIG. 7, the electro-conductive substrate 36, a conveying roller 37, an extruder 38, the crosshead 40, and the roller after extrusion 41 are illustrated. After the roller was heated at 160° C. for one hour with a hot air furnace, both ends of the rubber composition layer were removed such that the length was 224.2 mm. Furthermore, the roller was secondarily heated at 160° C. for one hour to produce a roller including a preparative coating layer being formed of the rubber composition and having a thickness of 2 mm.

The outer peripheral surface of the produced roller was polished using a plunge cutting mode cylinder polisher. A vitrified grinding wheel was used as the polishing grinding wheel. The abrasive grain was green silicon carbide (GC), and the grain size was 100 mesh. The number of rotation of the roller was 350 rpm, and the number of rotation of the polishing grinding wheel was 2050 rpm. The rotational direction of the roller was the same as the rotational direction of the polishing grinding wheel (following direction). The outer peripheral surface of the roller was polished at a cutting speed of 20 mm/min and a spark-out time (time at a cutting amount of 0 mm) at 0 second to produce an elastic roller e1. The thickness of the resin layer was adjusted to be 1.5 mm. The crown amount of the roller was 150 μm.

The surface of the elastic roller included the electroconductive resin layer having the protrusion derived from the edge of the opening of the bowl-shaped resin particle and the concavity derived from the opening of the bowl-shaped resin particle. The elastic roller was used as a charging roller T1. The results of evaluation are shown in Table 14.

Production Examples T2 to T16

Elastic rollers e2 to e16 were produced in the same manner as in the elastic roller e1 in Production Example T1 except that the kind of conductive rubber compositions and the polishing condition were changed as shown in Table 11. The surfaces of these elastic rollers each included the electroconductive resin layer having the protrusion derived from the edge of the opening of the bowl-shaped resin particle and the concavity derived from the opening of the bowl-shaped resin particle. These elastic rollers were used as charging rollers T2 to T16, respectively. The results of evaluation are shown in Table 14.

Production Example T17

1. Production of Elastic Roller

An elastic roller e17 was produced in the same manner as in Production Example T1 except that the kind of conductive rubber compositions and the polishing condition were changed as shown in Table 11.

2. Preparation of Conductive Resin Coating Solution

Methyl isobutyl ketone was added to a caprolactone-modified acrylic polyol solution "Placcel DC2016" (trade name, made by Daicel Corporation), and the solid content was adjusted to be 10% by mass. The four other materials shown in Table below were added based on 160 parts by mass of the solution to prepare a mixed solution. At this time, the block isocyanate mixture had an amount of isocyanate at "NCO/OH=1.0." Next, 200 g of the above mixed solution was placed in a glass bottle having an inner volume of 450 mL with 200 g of glass beads as a medium having an average particle diameter of 0.8 mm. Using a paint shaker dispersing machine, the mixed solution was dispersed for 24 hours. The glass beads were removed to prepare a conductive resin coating solution 1.

TABLE 10

| Material | Parts by mass |
|---|---|
| Caprolactone-modified acrylic polyol solution (trade name: Placcel DC2016, made by Daicel Corporation) | 160 |
| Composite conductive fine particle 1 (produced in Production Example d1) | 7.2 |
| Surface treated titanium oxide particle 1 (produced in Production Example d2) | 3.2 |
| Modified dimethylsilicone oil (trade name: SH28PA, made by Dow Corning Toray Co., Ltd.) | 0.08 |
| Block isocyanate mixture (7:3 mixture of butanone oxime block in hexamethylene diisocyanate (HDI) and that in isophorone diisocyanate (IPDI)) | 12.82 |

3. Production of Charging Roller

The elastic roller e17 was directed in the longitudinal direction, vertically immersed in the conductive resin coating solution 1, and coated by dipping. The immersion time was 9 seconds. As the take-up rate, the initial rate was 20 mm/s, and the final rate was 2 mm/s. In-between, the take-up rate was linearly changed with respect to time. The obtained coated product was air dried at normal temperature for 30 minutes, then dried at a temperature of 80° C. for one hour with a hot air circulation dryer, and further dried at a temperature of 160° C. for one hour to cure the coated product. Thus, a charging roller T17 having the second electroconductive resin layer formed thereon was produced. The results of evaluation are shown in Table 14.

Production Examples T18 and T19

Charging rollers T18 and T19 were produced in the same manner as in Production Example T17 except that the elastic roller e12 or e14 was used instead of the elastic roller e17. The results of evaluation are shown in Table 14.

Production Example T20

The surface of the elastic roller e10 produced in the same manner as in Production Example T10 was irradiated with an electron beam on the following condition to produce a charging roller T20. The irradiation with an electron beam was performed using an electron beam irradiating apparatus (made by Iwasaki Electric Co., Ltd.) having the largest accelerating voltage of 150 kV and the largest electron current of 40 mA. During the irradiation, purging with nitrogen gas was performed. The treatment condition was an accelerating voltage: 80 kV, an electron current: 20 mA, a treatment rate: 2.04 m/min, and a concentration of oxygen: 100 ppm. The apparatus constant of the electron beam irradiating apparatus at an accelerating voltage of 80 kV is 20.4, and the exposure dose calculated by the equation (1) is 200 kGy. The results of evaluation are shown in Table 14.

Production Examples T21 and T22

Charging roller T21 and T22 were produced in the same manner as in Production Example T20 except that the elastic roller e12 or e14 was used instead of the elastic roller e10. The results of evaluation are shown in Table 14.

Production Example T23

The kind of the conductive rubber composition was changed as shown in Table 11. In the polishing condition, the cutting speed was changed such that the cutting speed changed step-wise from 10 mm/min to 0.1 mm/min from a time when the grinding wheel contacted the roller including the preparative coating layer to a time when the outer diameter of the roller became 9 mm. Furthermore, the spark-out time was changed to 10 seconds. Except these, the process was performed in the same manner as in Production Example T1 to produce an elastic roller e23. The elastic roller had no protrusions on the roller surface. The elastic roller was used as a charging roller T23. The results of evaluation are shown in Table 14.

TABLE 11

| | | Polishing condition | | | | Polishing condition | |
|---|---|---|---|---|---|---|---|
| Elastic roller No. | Conductive rubber composition | Cutting speed (mm/min) | Spark-out | Elastic roller No. | Conductive rubber composition | Cutting speed (mm/min) | Spark-out |
| e1 | c1 | 20 | 0 | e10 | c10 | 20 | 0 |
| e2 | c2 | 20 | 0 | e11 | c11 | 20 | 0 |
| e3 | c3 | 20 | 0 | e12 | c12 | 20 | 0 |
| e4 | c4 | 20 | 0 | e13 | c13 | 20 | 0 |
| e5 | c5 | 20 | 0 | e14 | c14 | 20 | 0 |
| e6 | c6 | 20 | 0 | e15 | c15 | 10 | 1 |
| e7 | c7 | 20 | 0 | e16 | c16 | 20 | 0 |
| e8 | c8 | 20 | 0 | e17 | c17 | 20 | 0 |
| e9 | c9 | 30 | 0 | e23 | c18 | 10→0.1 | 10 |

Examples 1 to 73 and Comparative Examples 1 to 5

Example 1

Figure 6:
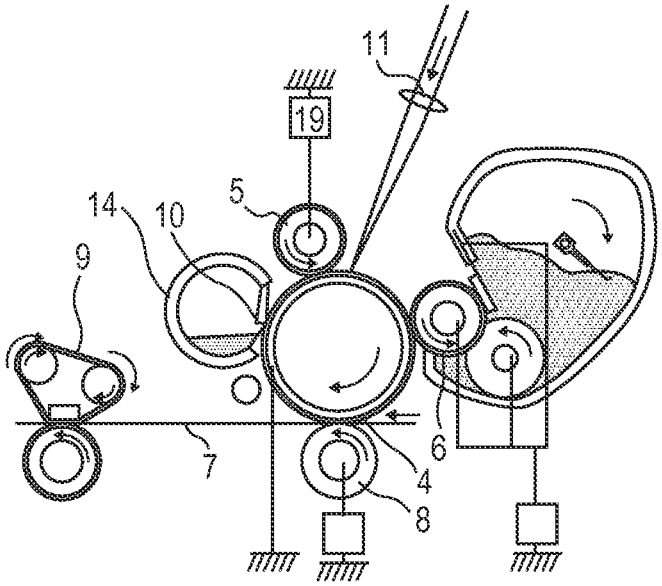
FIG. 6 is a schematic sectional view illustrating one aspect of the electrophotographic apparatus according to the present invention.

An HP Color LaserJet Enterprise CP4525n made by Hewlett-Packard Company (a cylindrical electrophotographic photosensitive member having a process speed of 240 mm/sec and a diameter of 24 mm was mountable), an electrophotographic apparatus having the configuration illustrated in FIG. 6 was used as the evaluation apparatus. The process cartridge was modified to use a spring on which a charging roller having an outer diameter of 9 mm was mountable. The spring could be pressed by applying 2.94 N (0.3 kgf) to one end of the spring and 5.88 N (0.6 kgf) in total to both ends thereof.

The electrophotographic photosensitive member A1 and charging roller T1 produced above were mounted on the above process cartridge, and left as it was for 24 hours or more under an environment of a temperature of 15° C. and a relative humidity of 10%. Subsequently, an image was evaluated under the environment. Specifically, a halftone image (image in which a horizontal line at a width of one dot and an interval of two dots was drawn in the direction perpendicular to the rotational direction of the electrophotographic photosensitive member) was output, and evaluated. In the evaluation, the state of unevenness, that is, horizontal streaks produced in the halftone image due to charging were visually observed, and determined on the following criterion.

TABLE 12

| Rank | Result of evaluation |
|---|---|
| 1 | No horizontal streaks are found. |
| 2 | Horizontal streaks are slightly found. |
| 3 | Horizontal streaks are found in positions corresponding to the rotation pitch of the charging roller. |
| 4 | Horizontal streaks are remarkably found. |

Examples 2 to 39

Examples 2 to 39 were evaluated in the same manner as in Example 1 except that the combination of the electrophotographic photosensitive member and the charging roller was changed as shown in Table 15. The results of evaluation are shown in Table 15.

Examples 40 to 73

Examples 40 to 73 were evaluated in the same manner as in Example 1 except that the combination of the electrophotographic photosensitive member and the charging roller was changed as shown in Table 15. The results of evaluation are shown in Table 15.

Comparative Examples 1 to 5

Comparative Examples 1 to 5 were evaluated in the same manner as in Example 1 except that the combination of the electrophotographic photosensitive member and the charging roller was changed as shown in Table 16. The results of evaluation are shown in Table 16. In all Comparative Examples, a poor image with horizontal streaks was remarkably found.

TABLE 13

| | | | Condition on irradiation with electron beam | | | | |
|---|---|---|---|---|---|---|---|
| Charging roller No. | Elastic roller No. | Second electroconductive resin layer | Accelerating voltage (kV) | Electron current (mA) | Treatment rate (m/min) | Apparatus constant | Exposure dose (kGy) |
| T1 | e1 | None | | | Not irradiated | | |
| T2 | e2 | | | | | | |
| T3 | e3 | | | | | | |
| T4 | e4 | | | | | | |
| T5 | e5 | | | | | | |
| T6 | e6 | | | | | | |
| T7 | e7 | | | | | | |
| T8 | e8 | | | | | | |
| T9 | e9 | | | | | | |
| T10 | e10 | | | | | | |
| T11 | e11 | | | | | | |
| T12 | e12 | | | | | | |
| T13 | e13 | | | | | | |
| T14 | e14 | | | | | | |
| T15 | e15 | | | | | | |
| T16 | e16 | | | | | | |
| T17 | e17 | Conductive resin coating solution 1 | | | Not irradiated | | |
| T18 | e12 | Conductive resin coating solution 1 | | | | | |
| T19 | e14 | Conductive resin coating solution 1 | | | | | |
| T20 | e10 | None | 80 | 20 | 2.04 | 20.4 | 200 |
| T21 | e12 | | 80 | 20 | 2.04 | 20.4 | 200 |
| T22 | e14 | | 80 | 20 | 2.04 | 20.4 | 200 |
| T23 | e23 | None | | | Not irradiated | | |

TABLE 14

| | | | | Measurement of shape (μm) | | | Concavity and protrusiton (μm) | | |
|---|---|---|---|---|---|---|---|---|---|
| Charging roller No. | Electric reistance (Ω) | Surface roughness (μm) Rzjis | Sm | Largest diameter | Smallest diameter of opening | Thickness of shell | Height difference | (Largest diameter)/(height difference) | (Largest diameter)/(smallest diameter of opening) |
| T1 | 2.23E+05 | 35 | 80 | 50 | 32 | 0.5 | 38 | 1.32 | 1.56 |
| T2 | 4.78E+05 | 52 | 100 | 100 | 60 | 0.8 | 63 | 1.59 | 1.67 |
| T3 | 4.92E+05 | 35 | 97 | 50 | 28 | 0.3 | 38 | 1.32 | 1.79 |

TABLE 14-continued

| Charging roller No. | Electric reistance (Ω) | Surface roughness (μm) Rzjis | Sm | Measurement of shape (μm) Largest diameter | Smallest diameter of opening | Thickness of shell | Concavity and protrusiton (μm) Height difference | (Largest diameter)/(height difference) | (Largest diameter)/(smallest diameter of opening) |
|---|---|---|---|---|---|---|---|---|---|
| T4 | 5.50E+05 | 61 | 102 | 120 | 100 | 1.2 | 75 | 1.60 | 1.20 |
| T5 | 2.41E+05 | 21 | 101 | 35 | 15 | 0.5 | 27 | 1.30 | 2.33 |
| T6 | 3.87E+05 | 12 | 100 | 17 | 13 | 0.1 | 20 | 0.85 | 1.31 |
| T7 | 5.07E+05 | 48 | 120 | 89 | 65 | 0.3 | 50 | 1.78 | 1.37 |
| T8 | 4.00E+05 | 18 | 60 | 30 | 14 | 0.8 | 20 | 1.50 | 2.14 |
| T9 | 2.80E+06 | 48 | 55 | 86 | 45 | 0.5 | 57 | 1.51 | 1.91 |
| T10 | 3.60E+05 | 30 | 170 | 53 | 35 | 0.4 | 40 | 1.33 | 1.51 |
| T11 | 5.24E+05 | 31 | 130 | 53 | 32 | 0.4 | 40 | 1.33 | 1.66 |
| T12 | 6.00E+05 | 30 | 100 | 53 | 26 | 0.4 | 40 | 1.33 | 2.04 |
| T13 | 4.10E+05 | 28 | 60 | 53 | 31 | 0.4 | 40 | 1.33 | 1.71 |
| T14 | 6.33E+05 | 31 | 40 | 53 | 32 | 0.4 | 40 | 1.33 | 1.66 |
| T15 | 1.91E+05 | 48 | 150 | 90 | 45 | 2.9 | 51 | 1.76 | 2.00 |
| T16 | 1.14E+06 | 11 | 130 | 20 | 12 | 2.8 | 13 | 1.54 | 1.67 |
| T17 | 7.80E+05 | 30 | 170 | 53 | 35 | 0.4 | 40 | 1.33 | 1.51 |
| T18 | 9.00E+05 | 30 | 100 | 53 | 26 | 0.4 | 40 | 1.33 | 2.04 |
| T19 | 9.50E+05 | 30 | 30 | 53 | 32 | 0.4 | 40 | 1.33 | 1.66 |
| T20 | 3.09E+05 | 30 | 170 | 53 | 35 | 0.4 | 40 | 1.33 | 1.51 |
| T21 | 5.14E+05 | 30 | 100 | 53 | 26 | 0.4 | 40 | 1.33 | 2.04 |
| T22 | 5.43E+05 | 31 | 40 | 53 | 32 | 0.4 | 40 | 1.33 | 1.66 |
| T23 | 8.70E+05 | 55 | 180 | 50 | 32 | 0.5 | 35 | 1.43 | 1.56 |

TABLE 15

| Example No. | Electro-photographic photo-sensitive member No. | Charging roller No. | Evaluation rank |
|---|---|---|---|
| 1 | A1 | T1 | 1 |
| 2 | A1 | T2 | 1 |
| 3 | A1 | T3 | 1 |
| 4 | A1 | T4 | 1 |
| 5 | A1 | T5 | 1 |
| 6 | A1 | T6 | 1 |
| 7 | A1 | T7 | 1 |
| 8 | A1 | T8 | 1 |
| 9 | A1 | T9 | 1 |
| 10 | A1 | T10 | 2 |
| 11 | A1 | T11 | 1 |
| 12 | A1 | T12 | 1 |
| 13 | A1 | T13 | 1 |
| 14 | A1 | T14 | 1 |
| 15 | A1 | T15 | 1 |
| 16 | A1 | T16 | 1 |
| 17 | A1 | T17 | 2 |
| 18 | A1 | T18 | 1 |
| 19 | A1 | T19 | 1 |
| 20 | A1 | T20 | 2 |
| 21 | A1 | T21 | 1 |
| 22 | A1 | T22 | 1 |
| 23 | A2 | T10 | 3 |
| 24 | A2 | T12 | 2 |
| 25 | A2 | T14 | 2 |
| 26 | A3 | T10 | 2 |
| 27 | A3 | T12 | 1 |
| 28 | A3 | T14 | 1 |
| 29 | A4 | T10 | 2 |
| 30 | A4 | T12 | 1 |
| 31 | A4 | T14 | 1 |
| 32 | A5 | T10 | 2 |
| 33 | A5 | T12 | 1 |
| 34 | A5 | T14 | 1 |
| 35 | A6 | T10 | 2 |
| 36 | A6 | T12 | 1 |
| 37 | A6 | T14 | 1 |

TABLE 15-continued

| Example No. | Electro-photographic photo-sensitive member No. | Charging roller No. | Evaluation rank |
|---|---|---|---|
| 38 | A7 | T10 | 2 |
| 39 | A7 | T12 | 1 |
| 40 | A7 | T14 | 1 |
| 41 | A8 | T10 | 2 |
| 42 | A8 | T12 | 1 |
| 43 | A8 | T14 | 1 |
| 44 | A9 | T10 | 2 |
| 45 | A9 | T12 | 1 |
| 46 | A9 | T14 | 1 |
| 47 | A10 | T10 | 2 |
| 48 | A10 | T12 | 1 |
| 49 | A10 | T14 | 1 |
| 50 | A11 | T10 | 3 |
| 51 | A11 | T12 | 2 |
| 52 | A11 | T14 | 2 |
| 53 | A12 | T10 | 2 |
| 54 | A12 | T12 | 1 |
| 55 | A12 | T14 | 1 |
| 56 | A13 | T10 | 2 |
| 57 | A13 | T12 | 1 |
| 58 | A13 | T14 | 1 |
| 59 | A14 | T10 | 3 |
| 60 | A14 | T12 | 2 |
| 61 | A14 | T14 | 2 |
| 62 | A15 | T10 | 2 |
| 63 | A15 | T12 | 1 |
| 64 | A15 | T14 | 1 |
| 65 | A16 | T10 | 2 |
| 66 | A16 | T12 | 1 |
| 67 | A16 | T14 | 1 |
| 68 | A17 | T10 | 3 |
| 69 | A17 | T12 | 2 |
| 70 | A17 | T14 | 2 |
| 71 | A18 | T10 | 2 |
| 72 | A18 | T12 | 1 |
| 73 | A18 | T14 | 1 |

TABLE 16

| Comparative Example No. | Electrophotographic photosensitive member No. | Charging roller No. | Evaluation rank |
|---|---|---|---|
| 1 | A1 | T23 | 4 |
| 2 | A19 | T10 | 4 |
| 3 | A19 | T12 | 4 |
| 4 | A19 | T14 | 4 |
| 5 | A19 | T23 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-011314, filed Jan. 24, 2013, which is hereby incorporated by reference herein in its entirety.

What is claimed is:

1. A process cartridge comprising:

a charging member; and an electrophotographic photosensitive member which is electrically charged upon being brought into contact with the charging member, wherein:

the charging member comprises an electro-conductive substrate and an electroconductive resin layer formed on the electroconductive substrate;

the electroconductive resin layer comprises a binder, a conductive fine particle, and a bowl-shaped resin particle which has an opening; and the surface of the charging member has a concavity derived from the opening of the bowl-shaped resin particle, and a protrusion derived from an edge of the opening of the bowl-shaped resin particle;

and wherein:

the electrophotographic photosensitive member comprises a support and a photosensitive layer formed on the support, and a surface layer of the electrophotographic photosensitive member comprises the following resin (α), resin (β), and compound (γ):

resin (α): polycarbonate resins having no siloxane structure at a terminal;

resin (β): at least one resin selected from the group consisting of polycarbonate resins having a siloxane structure at a terminal, polyester resins having a siloxane structure at a terminal, and acrylic resins having a siloxane structure at a terminal; and compound (γ): at least one compound selected from the group consisting of methyl benzoate, ethyl benzoate, benzyl acetate, ethyl 3-ethoxypropionate, and diethylene glycol ethyl methyl ether, wherein the resin (α) is a polycarbonate resin A having a repeating structural unit represented by the following formula (A):

(A)

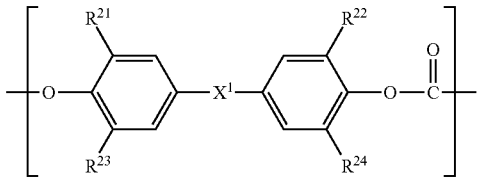

wherein $R^{21}$ to $R^{24}$ each independently represent a hydrogen atom or a methyl group; $X^1$ represents a single bond, a cyclohexylidene group, or a divalent group having a structure represented by the following formula (C):

(C)

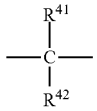

wherein $R^{41}$ and $R^{42}$ each independently represent a hydrogen atom, a methyl group, or a phenyl group.

2. The process cartridge according to claim 1, wherein the polycarbonate resin A is a polymer having only one kind of repeating structural unit selected from repeating structural units represented by the following formulas (A-1) to (A-8) or a polymer having a combination of two or more kinds of repeating structural units represented by the following formulas (A-1) to (A-8):

(A-1)

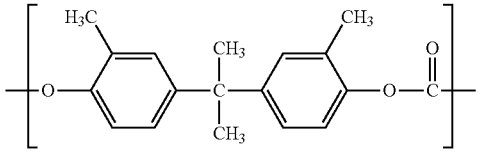

(A-2)

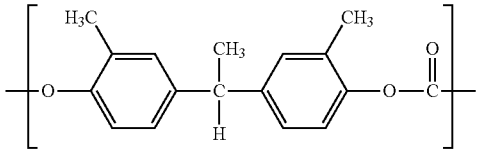

(A-3)

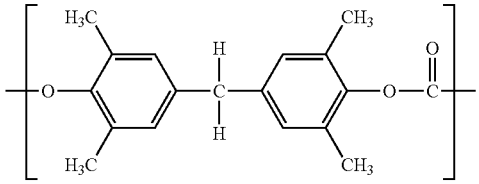

(A-4)

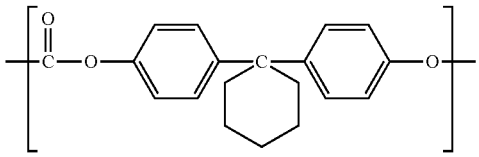

(A-5)

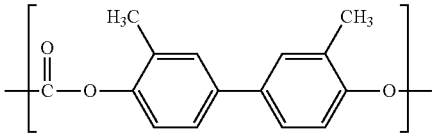

-continued (A-6)

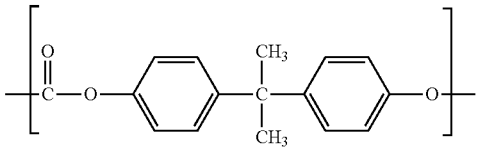

(A-7)

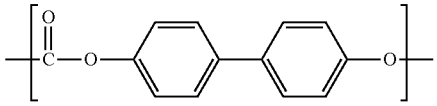

(A-8)

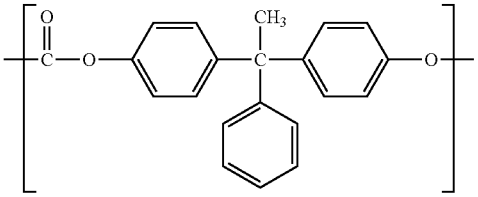

3. The process cartridge according to claim 1, wherein the resin (β) is a polyester resin B' having a repeating structural unit represented by the following formula (B') and a terminal structure represented by the following formula (D):

(B')

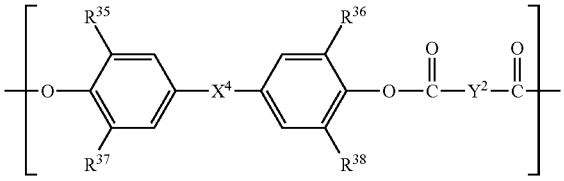

wherein $R^{35}$ to $R^{38}$ each independently represent a hydrogen atom or a methyl group; $X^4$ represents a single bond, a cyclohexylidene group, or a divalent group having a structure represented by the following formula (C'); $Y^2$ represents a m-phenylene group, a p-phenylene group, or a divalent group in which two p-phenylene groups are bonded via an oxygen atom:

(C')

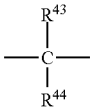

wherein $R^{43}$ and $R^{44}$ each independently represent a hydrogen atom, a methyl group, or a phenyl group, (D)

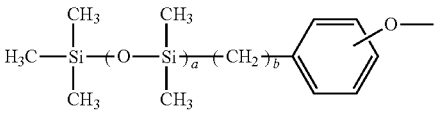

wherein a and b represent a repetition number of the structure unit within the brackets, an average value of a is 20 or more and 100 or less, and an average value of b is 1 or more and 10 or less.

4. The process cartridge according to claim 1, wherein the bowl-shaped resin particle is a particle having a resin shell, an opening derived from the partial lack of the shell, and a spherical concavity.

5. The process cartridge according to claim 4, wherein an electroconductive resin layer is formed along an inner wall of the spherical concavity of the bowl-shaped resin particle.

6. A process cartridge comprising:

a charging member; and an electrophotographic photosensitive member which is electrically charged upon being brought into contact with the charging member, wherein:

the charging member comprises an electro-conductive substrate and an electroconductive resin layer formed on the electroconductive substrate;

the electroconductive resin layer comprises a binder, a conductive fine particle, and a bowl-shaped resin particle which has an opening; and the surface of the charging member has a concavity derived from the opening of the bowl-shaped resin particle, and a protrusion derived from an edge of the opening of the bowl-shaped resin particle;

and wherein:

the electrophotographic photosensitive member comprises a support and a photosensitive layer formed on the support, and a surface layer of the electrophotographic photosensitive member comprises the following resin (α), resin (β), and compound (γ):

resin (α): at least one resin selected from the group consisting of polycarbonate resins having no siloxane structure at a terminal and polyester resins having no siloxane structure at a terminal;

resin (β): polycarbonate resins having a siloxane structure at a terminal, polyester resins having a siloxane structure at a terminal, and compound (γ): at least one compound selected from the group consisting of methyl benzoate, ethyl benzoate, benzyl acetate, ethyl 3-ethoxypropionate, and diethylene glycol ethyl methyl ether, wherein the resin (β) is a polycarbonate resin A' having a repeating structural unit represented by the following formula (A') and a terminal structure represented by the following formula (D):

(A′)

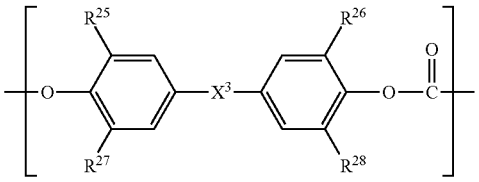

wherein $R^{25}$ to $R^{28}$ each independently represent a hydrogen atom or a methyl group; $X^3$ represents a single bond, a cyclohexylidene group, or a divalent group having a structure represented by the following formula (C′):

(C′)

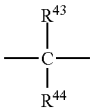

wherein $R^{43}$ and $R^{44}$ each independently represent a hydrogen atom, a methyl group, or a phenyl group, (D)

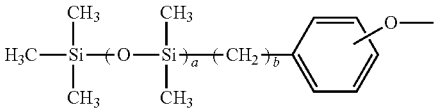

wherein a and b represent a repetition number of the structure unit within the brackets, an average value of a is 20 or more and 100 or less, and an average value of b is 1 or more and 10 or less.

7. The process cartridge according to claim 6, wherein the resin (α) is a polyester resin B having a repeating structural unit represented by the following formula (B):

(B)

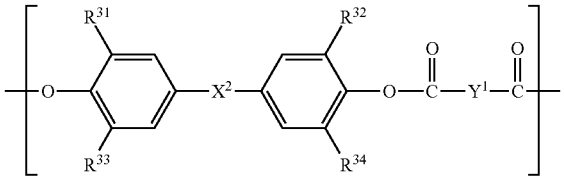

wherein $R^{31}$ to $R^{34}$ each independently represent a hydrogen atom or a methyl group; $X^2$ represents a single bond, a cyclohexylidene group, or a divalent group having a structure represented by the following formula (C); $Y^1$ represents a m-phenylene group, a p-phenylene group, or a divalent group in which two p-phenylene groups are bonded via an oxygen atom.

(C)

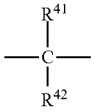

wherein $R^{41}$ and $R^{42}$ each independently represent a hydrogen atom, a methyl group, or a phenyl group.

8. The process cartridge according to claim 7, wherein the polyester resin B is a polymer having only one kind of repeating structural unit selected from repeating structural units represented by the following formulas (B-1) to (B-9) or a polymer having a combination of two or more kinds of repeating structural units represented by the following formulas (B-1) to (B-9):

(B-1)

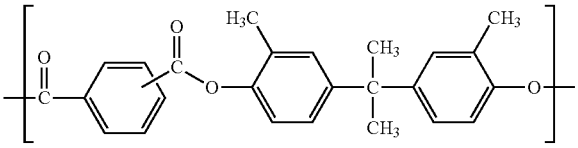

(B-2)

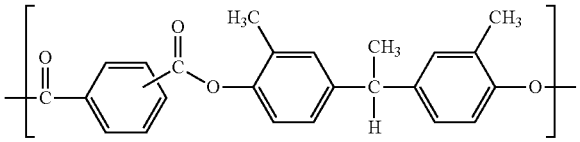

(B-3)

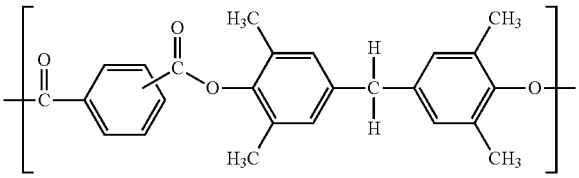

(B-4)

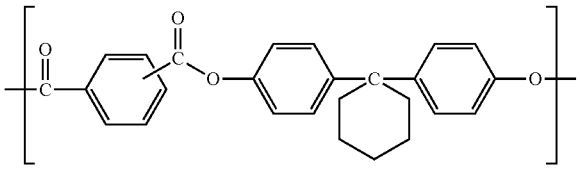

(B-5)

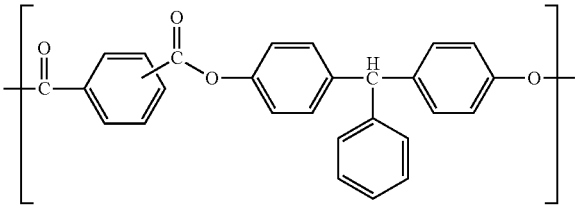

(B-6)

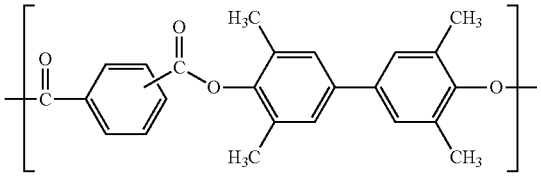

-continued (B-7)

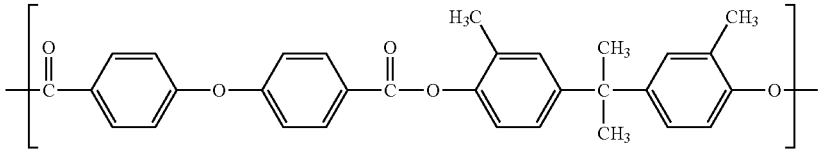

(B-8)

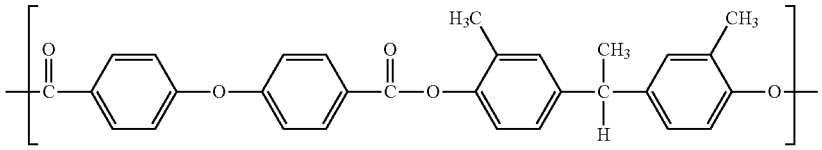

(B-9)

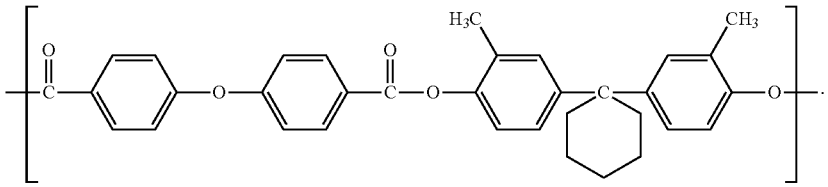

9. The process cartridge according to claim 6, wherein the bowl-shaped resin particle is a particle having a resin shell, an opening derived from the partial lack of the shell, and a spherical concavity.

10. The process cartridge according to claim 9, wherein an electroconductive resin layer is formed along an inner wall of the spherical concavity of the bowl-shaped resin particle.

11. An electrophotographic apparatus comprising a process cartridge, wherein, a process cartridge comprises:

a charging member; and an electrophotographic photosensitive member which is electrically charged upon being brought into contact with the charging member, wherein:

the charging member comprises an electro-conductive substrate and an electroconductive resin layer formed on the electroconductive substrate;

the electroconductive resin layer comprises a binder, a conductive fine particle, and a bowl-shaped resin particle which has an opening; and the surface of the charging member has a concavity derived from the opening of the bowl-shaped resin particle, and a protrusion derived from an edge of the opening of the bowl-shaped resin particle;

and wherein:

the electrophotographic photosensitive member comprises a support and a photosensitive layer formed on the support, and a surface layer of the electrophotographic photosensitive member comprises the following resin (α), resin (β), and compound (γ):

resin (α): polycarbonate resins having no siloxane structure at a terminal;

resin (β): at least one resin selected from the group consisting of polycarbonate resins having a siloxane structure at a terminal, polyester resins having a siloxane structure at a terminal, and acrylic resins having a siloxane structure at a terminal; and compound (γ): at least one compound selected from the group consisting of methyl benzoate, ethyl benzoate, benzyl acetate, ethyl 3-ethoxypropionate, and diethylene glycol ethyl methyl ether, wherein the resin (α) is a polycarbonate resin A having a repeating structural unit represented by the following formula (A):

(A)

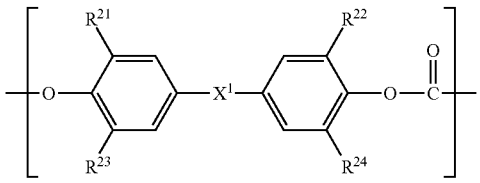

wherein $R^{21}$ to $R^{24}$ each independently represent a hydrogen atom or a methyl group; $X^1$ represents a single bond, a cyclohexylidene group, or a divalent group having a structure represented by the following formula (C):

(C)

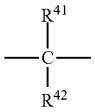

wherein $R^{41}$ and $R^{42}$ each independently represent a hydrogen atom, a methyl group, or a phenyl group.

* * * * *